US008609312B2

(12) United States Patent
Itabashi et al.

(10) Patent No.: US 8,609,312 B2
(45) Date of Patent: Dec. 17, 2013

(54) TONER

(75) Inventors: Hitoshi Itabashi, Yokohama (JP); Akane Masumoto, Yokohama (JP); Takashi Kenmoku, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 13/457,982

(22) Filed: Apr. 27, 2012

(65) Prior Publication Data

US 2012/0295191 A1 Nov. 22, 2012

(30) Foreign Application Priority Data

May 18, 2011 (JP) ..... 2011-111720

(51) Int. Cl.
*G03G 9/097* (2006.01)

(52) U.S. Cl.
CPC ..... *G03G 9/09733* (2013.01)
USPC ..... 430/108.4; 430/108.3

(58) Field of Classification Search
USPC ..... 430/108.4, 108.3
See application file for complete search history.

(56) References Cited

U.S. PATENT DOCUMENTS

| | | | | |
|---|---|---|---|---|
| 3,888,678 | A * | 6/1975 | Bailey et al. | 430/528 |
| 4,134,847 | A * | 1/1979 | Oda et al. | 430/108.3 |
| 4,918,047 | A * | 4/1990 | Ikeda et al. | 503/216 |
| 5,364,725 | A * | 11/1994 | Wilson et al. | 430/108.4 |
| 5,439,771 | A | 8/1995 | Baba et al. | |
| 5,460,913 | A * | 10/1995 | Kataoka et al. | 430/106.3 |
| 5,494,770 | A | 2/1996 | Baba et al. | |
| 5,573,880 | A | 11/1996 | Mayama et al. | |
| 5,576,133 | A | 11/1996 | Baba et al. | |
| 5,744,278 | A | 4/1998 | Ayaki et al. | |
| 5,766,814 | A | 6/1998 | Baba et al. | |
| 5,985,502 | A | 11/1999 | Ayaki et al. | |
| 6,083,655 | A | 7/2000 | Itabashi et al. | |
| 6,106,990 | A | 8/2000 | Tazawa et al. | |
| 6,124,070 | A | 9/2000 | Baba et al. | |
| 6,165,663 | A | 12/2000 | Baba et al. | |
| 6,358,658 | B1 | 3/2002 | Tazawa et al. | |
| 6,500,593 | B2 | 12/2002 | Abe et al. | |
| 6,566,028 | B2 | 5/2003 | Tazawa et al. | |
| 6,689,525 | B2 | 2/2004 | Itabashi | |
| 6,790,576 | B2 | 9/2004 | Fujimoto et al. | |
| 6,808,855 | B2 | 10/2004 | Ayaki et al. | |
| 7,252,917 | B2 | 8/2007 | Ohno et al. | |
| 7,323,282 | B2 | 1/2008 | Ohno et al. | |
| 8,053,156 | B2 | 11/2011 | Abe et al. | |
| 8,178,275 | B2 | 5/2012 | Tani et al. | |
| 2008/0286675 | A1 | 11/2008 | Tani et al. | |
| 2011/0159425 | A1 | 6/2011 | Itabashi et al. | |
| 2012/0164569 | A1 | 6/2012 | Fujimoto et al. | |
| 2012/0172562 | A1 | 7/2012 | Kenmoku et al. | |

FOREIGN PATENT DOCUMENTS

| | | | |
|---|---|---|---|
| JP | 7-152207 | A | 6/1995 |
| JP | 8-6297 | A | 1/1996 |
| JP | 2002-287429 | A | 10/2002 |
| JP | 2004-219507 | A | 8/2004 |
| WO | WO 2012157781 | A1 * | 11/2012 |

OTHER PUBLICATIONS

Itabashi, et al., U.S. Appl. No. 13/457,976, filed Apr. 27, 2012.

* cited by examiner

*Primary Examiner* — Christopher Rodee
(74) *Attorney, Agent, or Firm* — Fitzpatrick, Cella, Harper and Scinto

(57) ABSTRACT

A toner is provided which has toner particles containing a charging component and containing an aromatic compound represented by the following formula (1):

Formula (1)

wherein $R^1$ to $R^3$ each independently represent a hydrogen atom, a hydroxyl group, a carboxyl group, an alkyl group having 1 to 18 carbon atom(s) or an alkoxyl group having 1 to 18 carbon atom(s); $R^4$ to $R^7$ each independently represent a hydrogen atom, a hydroxyl group, an alkyl group having 1 to 18 carbon atom(s) or an alkoxyl group having 1 to 18 carbon atom(s); $R^8$ represents a hydrogen atom or a methyl group; and m represents an integer of 1 to 3.

5 Claims, 1 Drawing Sheet

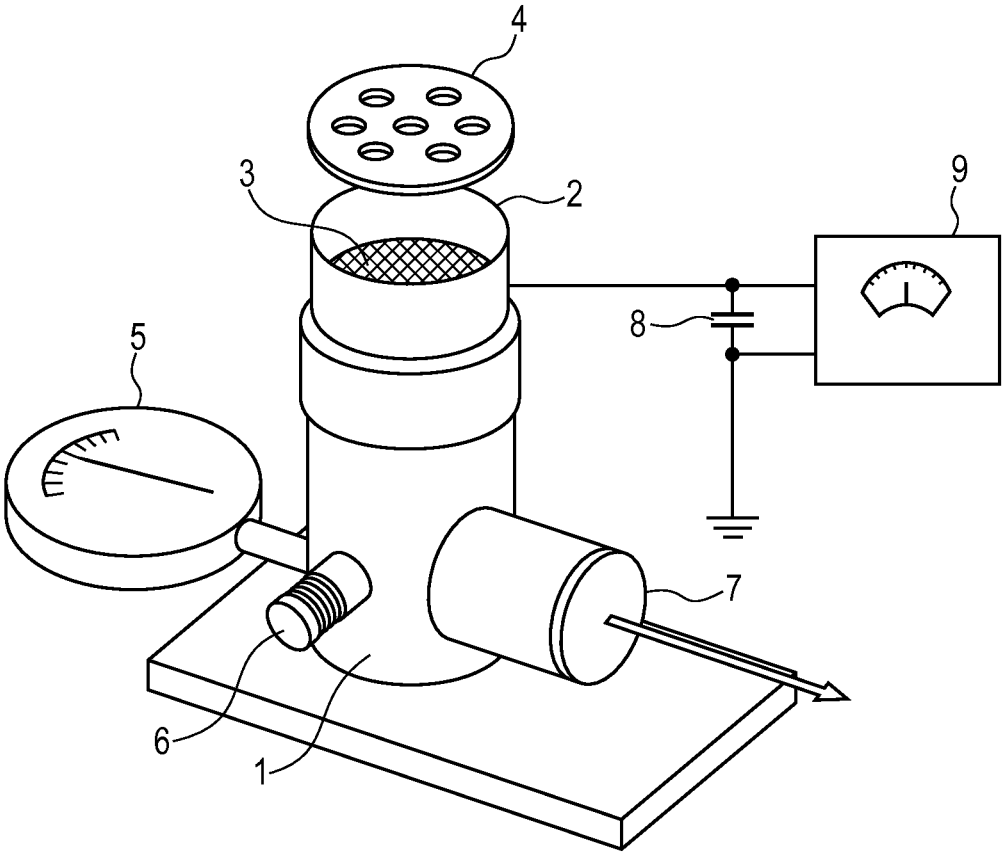
4
3
2
9
8
5
7
6
1

TONER

BACKGROUND OF THE INVENTION

1. Field of the Invention

The present invention relates to a toner for developing electrostatic latent images in image forming processes such as electrophotography and electrostatic printing, or a toner for forming toner images in an image forming process of a toner jet system.

2. Description of the Related Art

In recent years, on account of requirements for making printers and copying machines more high-speed, more highly stable and much more compact, it is sought to reduce the number of articles of component parts as individual component parts are made more high-function. In order to attain a stable image density in electrophotographic systems, it is necessary to set up development conditions that are always stable in a development process. However, where a toner has an unstable charge quantity, a high load may be applied to a system for controlling the developing performance, such that development bias conditions and so forth must be made proper every time, and this may often make apparatus large in size and result in a high production cost. In order to lessen such a load, the toner is required to be improved in the stability of its charge quantity, in particular, the stability of charging against any changes in temperature and humidity.

Proposals to improve such environmental stability of charge quantity of toner have been made in a large number. Of these, it is prevailing to control it by the aid of a charge control agent, and proposed are a toner containing a carixarene compound, one making use of an iron-containing azo dye and one making use of an organic boron compound (e.g., Japanese Patent Applications Laid-open No. H07-152207, No. H08-6297, No. 2002-287429, No. 2004-219507).

However, such toners as above are still unsatisfactory for the charge quantity of toner and charging rise performance thereof that are concerned in any changes in temperature and humidity environmental factors surrounding the toners. It has come about that image density comes to change during printing and, especially in a high-temperature and high-humidity environment, difficulties such as image fog occur with any non-uniformity of charge quantity distribution.

SUMMARY OF THE INVENTION

Accordingly, an object of the present invention is to provide a toner the charge quantity and charging rise of which can not easily be affected by such changes in temperature and humidity environments.

The present invention is concerned with a toner having toner particles each of which contains a charging component, an aromatic compound having a carboxyl group, and a colorant; wherein the aromatic compound is an aromatic compound represented by the following formula (1):

Formula (1)

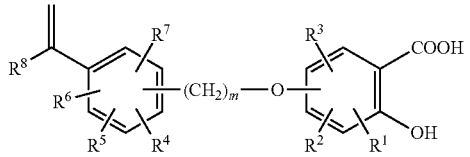

wherein $R^1$ to $R^3$ each independently represent a hydrogen atom, a hydroxyl group, a carboxyl group, an alkyl group having 1 to 18 carbon atom(s) or an alkoxyl group having 1 to 18 carbon atom(s); $R^4$ to $R^7$ each independently represent a hydrogen atom, a hydroxyl group, an alkyl group having 1 to 18 carbon atom(s) or an alkoxyl group having 1 to 18 carbon atom(s); $R^8$ represents a hydrogen atom or a methyl group; and m represents an integer of 1 to 3.

According to the present invention, a toner can be obtained the charge quantity and charging rise performance of which can not easily be affected by any changes in temperature and humidity environments.

Further features of the present invention will become apparent from the following description of exemplary embodiments with reference to the attached drawings.

BRIEF DESCRIPTION OF THE DRAWINGS

FIGURE is a view showing an instrument used to measure the triboelectric charge quantity of a developer making use of the toner of the present invention.

DESCRIPTION OF THE EMBODIMENTS

Preferred embodiments of the present invention will now be described in detail in accordance with the accompanying drawings.

The present inventors have discovered that toner particles containing a charging component may be incorporated therein with an aromatic compound represented by the formula (1) shown below and this enables a toner to be obtained which can not easily be affected by variations in temperature and humidity, can stably enjoy a high saturated charge quantity and also has a high charging rise speed. Thus, they have accomplished the present invention.

Electric charges generated on toner particle surfaces by triboelectric charging commonly tend to be influenced by the absolute moisture content on the toner particle surfaces. This is because the molecules of water participate greatly in the delivery of electric charges, where the speed of leakage of the electric charges becomes higher with an increase in the frequency of desorption of water molecules on the toner particle surfaces in a high-humidity environment to cause a lowering of saturated charge quantity and a lowering of charging rise speed, as so considered.

However, that the component having the formula (1) structure is present in the toner particles enables the electric charges generated by triboelectric charging to be stably retained on the toner particles even in a high-temperature and high-humidity environment, and makes the toner not easily affected by the outside temperature and humidity.

The mechanism is unclear, but the present inventors consider it to be that the component having the formula (1) structure easily retains in its molecule interior the electric charges generated by triboelectric charging.

The present invention is described below in detail.

The toner of the present invention requires for itself to have triboelectric chargeability. For that end, it is required for the toner to contain a charging component in its toner particles. The charging component may at least be a component capable of charging the toner triboelectrically to such an extent as to be usable as a toner, and, e.g., a binder resin having a polarity or a compound known as a positively charging or negatively charging charge control agent may be used.

Then, in addition to the charging component, it is required for the toner to contain an aromatic compound represented by the following formula (1). The formula (1) aromatic compound is a compound showing the effect of stably retaining electric charges generated by the aid of the charging component.

Formula (1)

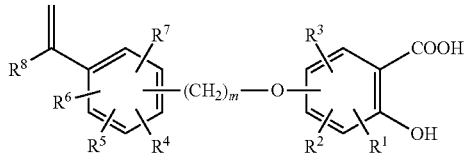

wherein $R^1$ to $R^3$ each independently represent a hydrogen atom, a hydroxyl group, a carboxyl group, an alkyl group having 1 to 18 carbon atom(s) or an alkoxyl group having 1 to 18 carbon atom(s); $R^4$ to $R^7$ each independently represent a hydrogen atom, a hydroxyl group, an alkyl group having 1 to 18 carbon atom(s) or an alkoxyl group having 1 to 18 carbon atom(s); $R^8$ represents a hydrogen atom or a methyl group; and m represents an integer of 1 to 3.

The aromatic compound represented by the formula (1) has a structure wherein an aromatic ring having a vinyl group stands linked with a salicylic acid structure through an alkyl ether that is advantageous for electronic conduction. Where such a formula (1) aromatic compound is made present together with the charging component, the chargeability required as the toner can be made not to be easily affected by any environmental variations. What is important is a large conjugated structure that extends from such a salicylic acid derivative, and this plays such a role that the electric charges generated by triboelectric charging are retained while restraining the toner so as to be affected at minimum by the outside temperature and humidity, as so considered. That the aromatic ring has a vinyl group as a substituent has brought an improvement in the speed of delivery of electrons between the formula (1) aromatic compound and the binder resin to improve the speed of charging rise, as so considered.

The toner of the present invention can be produced by various production processes.

For example, the process therefor may include a kneading pulverization process, in which a binder resin, a colorant and a release agent are mixed, followed by the steps of kneading, pulverization and then classification to obtain toner particles; a dissolution suspension process, in which a binder resin, a colorant and a release agent are dissolved or dispersed and mixed in an organic solvent to carry out granulation in an aqueous medium, followed by solvent removal to obtain toner particles; and an emulsion aggregation process, in which fine particles of each of a binder resin, a colorant and a release agent are finely dispersed in an aqueous medium, and their fine particles are so agglomerated as to have toner particle diameter, to obtain toner particles. The formula (1) aromatic compound may be incorporated into the toner particles when the toner is produced by any of these processes.

In the present invention, the aromatic compound may preferably be in a content of from 0.10 μmol/g or more to 200 μmol/g or less in the toner. As long as it is in a content within this range, it can have a better charge retention performance in the interiors of toner particles. Its content in the toner of the present invention may be controlled by controlling the amounts of toner components to be fed when the toner is produced.

The binder resin having a polarity that is used as the charging component is described below.

The binder resin having a polarity is, stated broadly, a resin that may readily cause triboelectric charging, i.e., may relatively easily make the delivery of electric charges. It may include resins having therein an ether linkage, an ester linkage or an amide linkage, and resins having a polar group such as a carboxyl group, a sulfonic acid group or a hydroxyl group. Stated specifically, it is a polyester resin, a polyether resin, a polyamide resin or a styrene-acrylic resin, and may include resins having a carboxyl group, a sulfonic acid group or a hydroxyl group, and, in addition, hybrid resins formed by combining any of these. Also, a vinyl polymer unit in a vinyl resin or hybrid resin may have a cross-linked structure, cross-linked with a cross-linking agent having two or more vinyl groups.

In particular, a resin having an acid value is readily triboelectrically chargeable, and is effective as a toner material. The resin having an acid value may include polyester resins, and styrene-acrylic resins containing a unit having a carboxyl group or a sulfonic acid group. Such a polyester resin, having an acid value, may include resins having a carboxyl group at the terminal. It may also be a resin which is a polyester synthesized by using a trifunctional or higher polybasic carboxylic acid and part of carboxyl groups of which remains without being esterified.

As those having a high polarity among monomers constituting the styrene-acrylic resin, any known monomers may be used, which may specifically include the following: Monomers having carboxyl groups, as exemplified by α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, alkenyladipic acids, or acid anhydrides of these and monoesters of these; monomers having hydroxyl groups, as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl)styrene;

unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester, and methyl mesaconate half ester; and monomers having unsaturated sulfonic acid such as parastyrenesulfonic acid.

As a monomer copolymerizable with any of such monomers having a polarity, it may specifically include styrene and derivatives thereof, such as styrene, o-methylstyrene, m-methylstyrene, p-methylstyrene and α-methylstyrene; ethylene unsaturated monoolefins such as ethylene, propylene, butylene and isobutylene; vinyl halides such as vinyl chloride, vinylidene chloride, vinyl bromide and vinyl fluoride; vinyl esters such as vinyl acetate, vinyl propionate and vinyl benzoate; acrylates such as n-butyl acrylate and 2-hexyl acrylate; methacrylates obtained by converting acryl moieties of the above acrylates into methacrylates; methacrylic amino esters such as dimethylaminoethyl methacrylate and diethylaminoethyl methacrylate; vinyl ethers such as methyl vinyl ether and ethyl vinyl ether; vinyl ketones such as methyl vinyl ketone; N-vinyl compounds such as N-vinylpyrrole; vinylnaphthalenes; and acrylic acid or methacrylic acid derivatives such as acrylonitrile, methacrylonitrile and acrylamide. Any of vinyl monomers may optionally be used in combination of two or more types.

There are no particular limitations on a polymerization initiator usable in producing the styrene-acrylic resin, and any known peroxide type polymerization initiator and azo type polymerization initiator may be used. As an organic type peroxide type polymerization initiator, it may include peroxy esters, peroxydicarbonates, dialkyl peroxides, peroxyketals, ketone peroxides, hydroperoxides and diacyl peroxides. As an inorganic type peroxide type polymerization initiator, it may include peroxy esters such as t-butyl peroxyacetate, t-butyl peroxypivarate, t-butyl peroxyisobutyrate, t-hexyl peroxyacetate, t-hexyl peroxypivarate, t-hexyl peroxyisobutyrate, t-butyl peroxyisopropyl monocarbonate, and t-butyl peroxy-2-ethylhexyl monocarbonate; diacyl peroxides such as benzoyl peroxide; peroxydicarbonates such as diisopropyl peroxydicarbonate; peroxyketals such as 1,1-di-t-hexylperoxycyclohexane; dialkyl peroxides such as di-t-butyl peroxide; and t-butyl peroxyallylmonocarbonate. As the azo type polymerization initiator, it may include 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile, azobisisobutyronitrile, and dimethyl-2,2'-azobis(2-methylrpopionate).

Meanwhile, the polyester resin is formed by polycondensation of a polyhydric alcohol component and a polybasic carboxylic acid component.

The polyhydric alcohol component constituting the polyester resin may include the following. Stated specifically, as a dihydric alcohol component for example, it may include bisphenol-A alkylene oxide addition products such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher alcohol component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As the polybasic carboxylic acid component, it may include, e.g., aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; and unsaturated dicarboxylic acids such as fumaric acid, maleic acid and citraconic acid, or anhydrides thereof.

Of these, it is particularly preferable to use a polyester resin having as a diol component a bisphenol derivative and as an acid component a dibasic or higher carboxylic acid or an anhydride thereof (e.g., fumaric acid, maleic acid, maleic anhydride, phthalic acid, terephthalic acid, trimellitic acid or pyromellitic acid) or a lower alkyl ester thereof, and obtained by polycondensation of any of these.

As the hybrid resin, a hybrid resin is preferred which has a polyester structure as its backbone skeleton and has been modified with a vinyl monomer.

As a method by which the polyester resin is hybridized by using a vinyl monomer, any known method may be used. Stated specifically, it may include, e.g., a method in which the polyester is vinyl-modified in the presence of a peroxide type initiator, and a method in which a polyester resin having an unsaturated group is graft-modified to produce the hybrid resin.

The acid value of the resin may be given as an index showing the height of polarity in the present invention. In the present invention, the binder resin having a polarity may preferably have an acid value of from 2.0 mgKOH/g or more to 60.0 mgKOH/g or less. As long as its acid value is within this range, appropriate electric charges can be retained and also its moisture absorption can be kept low, as being particularly preferred.

How to control the acid value of the resin is described here. In the case of the styrene-acrylic resin, the acid value may be controlled by controlling the amount of the acid component to be fed as a monomer. Also, in the case of the polyester resin, the amounts of the acid group and hydroxyl group may be controlled by controlling the mass ratio of the polyhydric alcohol component to the polybasic carboxylic acid component.

It is also preferable to control the surface acid value of the toner particles. The surface acid value of the toner particles is an acid value measured when the toner is dispersed in an aqueous medium. How to measure it will be described later. The toner particles may preferably have a surface acid value of from 0.050 mgKOH/g or more to 1.000 mgKOH/g or less, and this is because the chargeability of the toner depends greatly on the acid value of the toner particle surfaces, as so considered. In order to control the surface acid value of toner particles, it is necessary to control the acid value of the resin to be introduced into the toner particles. In the case of a toner produced by granulation in an aqueous medium, it can be achieved to do so by controlling the acid value of a relatively hydrophilic resin, which may easily move to the toner particle surfaces.

As the charging component, a compound known as a positively charging or negatively charging charge control agent may be used. Stated specifically, it is an organometallic complex or chelate compound, a quaternary ammonium salt, Nigrosine dye, an azine dye, a triphenylmethane type dye or pigment, or the like. The organometallic complex or chelate compound usable in the present invention may include metal compounds of monoazo dyes, metal compounds of acetylacetone, metal compounds of aromatic dicarboxylic acid, metal compounds of aromatic hydroxycarboxylic acid, and metal compounds of benzilic acid.

The colorant usable in the toner of the present invention may include any known colorants such as conventionally known various dyes or pigments.

As a color pigment for magenta, it may include C.I. Pigment Red 3, 5, 17, 22, 23, 38, 41, 112, 122, 123, 146, 149, 178, 179, 190, 202; and C.I. Pigment Violet 19, 23. Any of these pigments may be used alone or a pigment may be used in combination with a dye.

As a color pigment for cyan, it may include C.I. Pigment Blue 15, 15:1, 15:3, or copper phthalocyanine pigments the phthalocyanine skeleton of which has been substituted with 1 to 5 phthalimide methyl group(s).

As a color pigment for yellow, it may include C.I. Pigment Yellow 1, 3, 12, 13, 14, 17, 55, 74, 83, 93, 94, 95, 97, 98, 109, 110, 154, 155, 166, 180, 185.

As a black colorant, usable are carbon black, aniline black, acetylene black, titanium black and a colorant toned in black by the use of yellow, magenta and cyan colorants shown above.

The toner of the present invention may also be used as a magnetic toner. In such a case, a magnetic material which may include the following may be used. It may include iron oxides such as magnetite, maghemite and ferrite, or iron oxides containing other metal oxides; metals such as Fe, Co and Ni, or alloys of any of these metals with any of metals such as Al, Co, Cu, Pb, Mg, Ni, Sn, Zn, Sb, Ca, Mn, Se and Ti, and mixtures of any of these. Stated more specifically, it may include, e.g., triiron tetraoxide ($Fe_3O_4$), iron sesquioxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$) and manganese iron oxide ($MnFe_2O_4$). Any of the above magnetic materials may be used alone or in combination of two or more types. A particularly preferable magnetic material is fine powder of triiron tetraoxide or $\gamma$-iron sesquioxide.

These magnetic materials may preferably have an average particle diameter of from 0.1 μm or more to 2 μm or less, and much preferably from 0.1 μm or more to 0.3 μm or less; which may preferably be those having, as magnetic properties under application of 795.8 kA/m (10 kilooersteds), a coercive force (Hc) of from 1.6 kA/m or more to 12 kA/m or less (20 oersteds or more to 150 oersteds or less) a saturation magnetization ($\sigma s$) of from 5 $Am^2/kg$ or more to 200 $Am^2/kg$ or less, and preferably from 50 $Am^2/kg$ or more to 100 $Am^2/kg$ or less, and a residual magnetization ($\sigma r$) of from 2 $Am^2/kg$ or more to 20 $Am^2/kg$ or less.

The magnetic material may preferably be used in an amount ranging from 10 parts by mass or more to 200 parts by mass or less, and much preferably from 20 parts by mass or more to 150 parts by mass or less, based on 100 parts by mass of the binder resin.

The toner of the present invention may contain a release agent. The release agent may include aliphatic hydrocarbon waxes such as low-molecular weight polyethylene, low-molecular weight polypropylene, microcrystalline wax and paraffin wax; oxides of aliphatic hydrocarbon waxes, such as polyethylene oxide wax; block copolymers of the aliphatic hydrocarbon waxes; waxes composed chiefly of a fatty ester, such as carnauba wax, sasol wax and montanate wax; those obtained by deoxidizing part or the whole of fatty esters, such as dioxidized carnauba wax; partially esterified products of polyhydric alcohols with fatty acids, such as monoglyceride behenate; and methyl esterified compounds having a hydroxyl group, obtained by hydrogenation of vegetable fats and oils.

As molecular weight distribution of the release agent, it is preferable that a main peak is present within the range of molecular weight of from 400 or more to 2,400 or less, and much preferably within the range of molecular weight of from 430 or more to 2,000 or less. This enables the toner to be provided with preferable thermal properties. The release agent may preferably be added in an amount of from 2.5 parts by mass or more to 40.0 parts by mass or less, and much preferably from 3.0 parts by mass or more to 15.0 parts by mass or less, in total mass and based on 100 parts by mass of the binder resin.

It is preferable that a fluidity-improving agent is added to the toner particles (toner base particles). The toner particles may be mixed together with the fluidity-improving agent by using a mixing machine such as Henschel mixer to blend the toner particles and the fluidity-improving agent sufficiently, thus a toner can be obtained which has the fluidity-improving agent on the toner particle surfaces.

The fluidity-improving agent may include fluorine resin powders such as fine vinylidene fluoride powder and fine polytetrafluoroethylene powder; fine silica powders such as fine silica powder obtained by wet-process production, fine silica powder obtained by dry-process production, and treated fine silica powder obtained by subjecting any of these fine silica powders to surface treatment with a treating agent such as silane coupling agent, a titanium coupling agent or a silicone oil; fine titanium oxide powder, fine alumina powder, treated fine titanium oxide powder and treated fine alumina powder.

The fluidity-improving agent may preferably be one having a specific surface area of 30 $m^2/g$ or more, and preferably 50 $m^2/g$ or more, as measured by the BET method utilizing nitrogen absorption, which one can give good results. The fluidity-improving agent may preferably be added in an amount of from 0.01 part by mass or more to 8.0 parts by mass or less, and much preferably from 0.1 parts by mass or more to 4.0 parts by mass or less, based on 100 parts by mass of the toner particles.

The toner of the present invention may preferably have a weight-average particle diameter (D4) of from 3.0 μm or more to 15.0 μm or less, and much preferably from 4.0 μm or more to 12.0 μm or less.

The toner of the present invention may be blended with a magnetic carrier so as to be used as a two-component developer. As the magnetic carrier, usable are surface-oxidized or unoxidized particles of a metal such as iron, lithium, calcium, magnesium, nickel, copper, zinc, cobalt, manganese, chromium or rare earth element, alloy particles or oxide particles of any of these, and ferrite finely divided into particles.

Where images are formed by using a developing method in which an alternating bias is applied to a developing sleeve, it is preferable to use a coated carrier obtained by coating the surfaces of magnetic carrier core particles with a resin. As a coating method, used is a method in which a coating fluid prepared by dissolving or suspending a coat material such as a resin in a solvent is made to adhere to the surfaces of magnetic carrier core particles or a method in which magnetic carrier core particles and a coat material are blended in the form of powder.

The coat material for the magnetic carrier core particles may include silicone resins, polyester resins, styrene resins, acrylic resins, polyamide, polyvinyl butyral, and aminoacrylate resins. Any of these may be used alone or in plurality. The amount of treatment with the coat material may preferably be from 0.1% by mass or more to 30% by mass or less, and much preferably from 0.5% by mass or more to 20% by mass or less, based on the mass of the carrier core particles.

The magnetic carrier may preferably have a volume-base 50% particle diameter (D50) of from 10 μm or more to 100 μm or less, and further preferably from 20 μm or more to 70 μm or less.

Where the two-component developer is prepared by blending the toner of the present invention and the magnetic carrier, they may preferably be blended in a proportion of from 2% by mass or more to 15% by mass or less, and much preferably from 4% by mass or more to 13% by mass or less, as toner concentration in the developer.

Measuring methods used in the present invention are shown below.

Measurement of Molecular Weight of Resin

The molecular weight and molecular weight distribution of the resin used in the present invention are measured by gel permeation chromatography (GPC) and calculated in terms of polystyrene. In the case of the resin having an acid value, the column elution rate depends also on the quantity of the acid groups, and hence it does not follow that accurate molecular weight and molecular weight distribution can be measured. Accordingly, it is necessary to ready a sample in which the acid groups have beforehand been capped. For such capping, methyl esterification is preferred, and a commercially available methyl esterifying agent may be used. Stated specifically, a method of treatment with trimethylsilyldiazomethane is available.

The measurement of molecular weight by GPC is made in the following way. A solution prepared by mixing the above resin in THF (tetrahydrofuran) and having been left to stand at room temperature for 24 hours is filtered with a solvent-resistant membrane filter "MAISHORIDISK" (available from Tosoh Corporation) of 0.2 μm in pore diameter to make up a sample solution, and the measurement is made under the following conditions. Here, in preparing the sample solution, the amount of the THF is so controlled that the resin may be in a concentration of 0.8% by mass. Incidentally, where the resin can not easily dissolve in the THF, a basic solvent such as DMF may also be used.

Instrument: HLC8120 GPC (detector: RI) (manufactured by Tosoh Corporation).

Columns: Combination of seven columns, SHODEX KF-801, KF-802, KF-803, KF-804, KF-805, KF-806 and KF-807 (available from Showa Denko K.K.).

Eluent: Tetrahydrofuran (THF).

Flow rate: 1.0 mL/min.

Oven temperature: 40.0° C.

Amount of sample injected: 0.10 mL.

To calculate the molecular weight of the sample for measurement, a molecular weight calibration curve is used which is prepared by using standard polystyrene resin columns enumerated below. Stated specifically, they are "TSK Standard Polystyrenes F-850, F-450, F-288, F-128, F-80, F-40, F-20, F-10, F-4, F-2, F-1, A-5000, A-2500, A-1000, A-500", trade name, available from Tosoh Corporation.

Measurement of Acid Value of Polar Resin

The acid value is the number of milligrams of potassium hydroxide necessary to neutralize the acid contained in 1 g of a sample. The acid value in the present invention is measured according to JIS K 0070-1992. Stated specifically, it is measured according to the following procedure.

Titration is carried out with use of a 0.100 mol/L potassium hydroxide ethyl alcohol solution (available from Kishida Chemical Co., Ltd.). The factor of this potassium hydroxide ethyl alcohol solution may be determined by using a potentiometric titrator (Potentiometric Titrator AT-510, manufactured by Kyoto Electronics Manufacturing Co., Ltd.). 100 mL of 0.100 mol/L hydrochloric acid is taken into a 250 mL tall beaker to carry out titration with the above potassium hydroxide ethyl alcohol solution, where the factor is determined from the amount of the potassium hydroxide ethyl alcohol solution required for neutralization. As the 0.100 mol/L hydrochloric acid, one prepared according to JIS K 8001-1998 is used.

Measurement conditions set when the acid value is measured are shown blow.

Titrator: Potentiometric titrator AT-510, manufactured by Kyoto Electronics Manufacturing Co., Ltd.).

Electrode: Composite glass electrode double junction type (Kyoto Electronics Manufacturing Co., Ltd.).

Titrator-controlling software: AT-WIN.

Titration analysis software: Tview.

Titration parameters and control parameters in carrying out the titration are set in the following way.

Titration Parameters

Titration mode: Blank titration.

Titration style: Whole-quantity titration.

Maximum titration quantity: 20 mL.

Wait time before titration: 30 seconds.

Titration direction: Automatic.

Control Parameters

End point judgment potential: 30 dE.

End point judgment potential value: 50 dE/d mL.

End point detection judgment: Not set.

Control speed mode: Standard.

Gain: 1.

Data collection potential: 4 mV.

Data collection titration quantity: 0.1 mL.

Run Proper:

0.100 g of a measuring sample is precisely weighed out into a 250 mL tall beaker, and 150 mL of a toluene-ethanol (3:1) mixed solvent is added thereto to make the former dissolve in the latter over a period of 1 hour. The titration is carried out by using the above potentiometric titrator and using the above potassium hydroxide ethyl alcohol solution.

Blank Run:

Titration is carried out according to the same procedure as the above except that the sample is not used (i.e., only the toluene-ethanol (3:1) mixed solvent is used).

The results obtained are substituted for the following equation to calculate the acid value.

$$A=[(C-B)\times f\times 5.611]/S$$

wherein A is the acid value (mgKOH/g), B is the amount (mL) of the potassium hydroxide ethyl alcohol solution in the blank run, C is the amount (mL) of the potassium hydroxide ethyl alcohol solution in the run proper, f is the factor of the potassium hydroxide ethyl alcohol solution, and S is the sample (g).

Measurement of Hydroxyl Value of Polar Resin

The hydroxyl value is the number of milligrams of potassium hydroxide necessary to neutralize acetic acid bonded to hydroxyl groups, when 1 g of a sample is acetylated. The hydroxyl value of the binder resin is measured according to JIS K 0070-1992. Stated specifically, it is measured according to the following procedure.

Preparation of Reagent:

25.0 g of guaranteed acetic anhydride is put into a 100 mL measuring flask, and pyridine is so added thereto as to add up to 100 mL in total mass, and these are thoroughly mixed by shaking to obtain an acetylating reagent. The acetylating reagent obtained is stored in a brown bottle so as not to be exposed to moisture, carbon dioxide and so forth.

Titration is carried out with use of a 1.0 mol/L potassium hydroxide ethyl alcohol solution (available from Kishida Chemical Co., Ltd.). The factor of this potassium hydroxide ethyl alcohol solution may be determined by using a potentiometric titrator (Potentiometric Titrator AT-510, manufactured by Kyoto Electronics Manufacturing Co., Ltd.). 100 mL of 1.00 mol/L hydrochloric acid is taken into a 250 mL tall beaker to carry out titration with the above potassium hydroxide ethyl alcohol solution, where the factor is determined from the amount of the potassium hydroxide ethyl alcohol solution required for neutralization. As the 1.00 mol/L hydrochloric acid, one prepared according to JIS K 8001-1998 is used.

Measurement conditions set when the hydroxyl value is measured are shown blow.

Titrator: Potentiometric titrator AT-510, manufactured by Kyoto Electronics Manufacturing Co., Ltd.).

Electrode: Composite glass electrode double junction type (Kyoto Electronics Manufacturing Co., Ltd.).

Titrator-controlling software: AT-WIN.

Titration analysis software: Tview.

Titration parameters and control parameters in carrying out the titration are set in the following way.

Titration Parameters

Titration mode: Blank titration.

Titration style: Whole-quantity titration.

Maximum titration quantity: 80 mL.

Wait time before titration: 30 seconds.

Titration direction: Automatic.

Control Parameters

End point judgment potential: 30 dE.

End point judgment potential value: 50 dE/d mL.

End point detection judgment: Not set.

Control speed mode: Standard.

Gain: 1.

Data collection potential: 4 mV.

Data collection titration quantity: 0.5 mL.

Run Proper:

2.00 g of a measuring sample having been pulverized is precisely weighed out into a 200 mL round-bottomed flask, and 5.00 mL of the above acetylating reagent is accurately added thereto by using a transfer pipette. Here, if the sample can not easily dissolve in the acetylating reagent, guaranteed toluene is added in a small quantity to effect dissolution.

A small funnel is placed at the mouth of the flask, and the flask bottom is immersed by 1 cm in a 97° C. glycerol bath and heated. At this point, in order to prevent the neck of the flask from being heated by the heat of the bath, it is preferable to cover the base of the neck of the flask with a cardboard sheet with a round hole made therein.

One hour later, the flask is taken out of the glycerol bath, and then left to cool. After it has been left to cool, 1.00 mL of water is added thereto through the funnel, followed by shaking to hydrolyze the acetic anhydride. In order to further hydrolyze it completely, the flask is again heated in the glycerol bath for 10 minutes. After it has been left to cool, the walls of the funnel and flask are washed with 5.00 mL of ethyl alcohol.

The sample obtained is moved to a 250 mL tall beaker, and 100 mL of a toluene-ethanol (3:1) mixed solvent is added thereto to make the former dissolve in the latter over a period of 1 hour. The titration is carried out by using the above potentiometric titrator and using the above potassium hydroxide ethyl alcohol solution.

Blank Run:

Titration is carried out according to the same procedure as the above except that the sample is not used.

The results obtained are substituted for the following equation to calculate the hydroxyl value.

$$A=[\{(B-C)\times 28.05\times f\}/S]+D$$

where A is the hydroxyl value (mgKOH/g), B is the amount (mL) of the potassium hydroxide ethyl alcohol solution in the blank run, C is the amount (mL) of the potassium hydroxide ethyl alcohol solution in the run proper, f is the factor of the potassium hydroxide ethyl alcohol solution, S is the sample (g), and D is the acid value (mgKOH/g) of the resin (measuring sample).

Measurement of Surface Acid Value of Toner Particles 120 mL of ion-exchanged water and 30 mL of methanol are put into a 300 mL flat-bottomed beaker made of glass and then mixed. To the mixture obtained, 7.5 mL of an aqueous 1% sodium dodecylbenzenesulfonate solution is added as a dispersant to prepare a dispersant solution.

While the dispersant solution in the beaker is stirred with a stirrer, 10.00 g of toner particles are little by little added to the dispersant solution to disperse the former in the latter. Ultrasonic dispersion treatment is further carried out for 60 seconds by means of an ultrasonic dispersion machine "Ultrasonic Dispersion system TETORA 150" (manufactured by Nikkaki Bios Co.). Here, in carrying out the ultrasonic dispersion treatment, the water temperature of the water tank is appropriately so controlled as to be 10° C. or more to 40° C. or less. Incidentally, where the toner particles have so low a surface acid value as not to be easily dispersed in the dispersant solution, it is effective to make appropriately higher the ethanol concentration in the dispersant solution.

The toner liquid dispersion thus obtained is subjected to neutralization titration with use of a 0.1 mol/L potassium hydroxide ethyl alcohol solution (available from Kishida Chemical Co., Ltd.).

Titration is carried out in the same way as the above method of measuring the polar resin acid value except that the sample solution used in its run proper is changed for the above toner liquid dispersion, and then the surface acid value of toner particles is likewise calculated.

Measurement of Weight Average Particle Diameter (D4) & Number Average Particle Diameter (D1) of Toner The weight-average particle diameter (D4) and number average particle diameter (D1) of the toner are calculated in the following way. A precision particle size distribution measuring instrument "Coulter Counter Multisizer 3" (registered trademark; manufactured by Beckman Coulter, Inc.) is used as a measuring instrument, which has an aperture tube of 100 μm in size and employing the aperture impedance method. To set the conditions for measurement and analyze the data of measurement, software "Beckman Coulter Multisizer 3 Version 3.51" (produced by Beckman Coulter, Inc.) is used, which is attached to Multisizer 3 for its exclusive use. Here, the measurement is made through 25,000 channels as effective measuring channels in number.

As an aqueous electrolytic solution used for the measurement, a solution may be used which is prepared by dissolving guaranteed sodium chloride in ion-exchanged water in a concentration of about 1% by mass, e.g., "ISOTON II" (available from Beckman Coulter, Inc.).

Before the measurement and analysis are made, the software for exclusive use is set in the following way.

On a "Change of Standard Measuring Method (SOM)" screen of the software for exclusive use, the total number of counts of a control mode is set to 50,000 particles. The number of time of measurement is set to one time and, as Kd value, the value is set which has been obtained using "Standard Particles, 10.0 μm" (available from Beckman Coulter, Inc.). Threshold value and noise level are automatically set by pressing "Threshold Value/Noise Level Measuring Button". Then, current is set to 1,600 μA, gain to 2, and electrolytic solution to ISOTON II, where "Flash for Aperture Tube after Measurement" is checked. On a "Setting of Conversion from Pulse to Particle Diameter" screen of the software for exclusive use, the bin distance is set to logarithmic particle diameter, the particle diameter bin to 256 particle diameter bins, and the particle diameter range to from 2 μm to 60 μm.

A specific way of measurement is as follows:

(1) 200 mL of the aqueous electrolytic solution is put into a 250 mL round-bottomed beaker made of glass for exclusive use in Multisizer 3, and this is set on a sample stand, where stirring with a stirrer rod is carried out at 24 revolutions/second in the anticlockwise direction. Then, a "Flash of Aperture" function of the software for exclusive use is operated to beforehand remove any dirt and air bubbles in the aperture tube.

(2) 30 mL of the aqueous electrolytic solution is put into a 100 mL flat-bottomed beaker made of glass. To this water, 0.3 mL of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to 3-fold by mass.

(3) An ultrasonic dispersion machine of 120 W in electric output "Ultrasonic Dispersion system TETORA 150" (manufactured by Nikkaki Bios Co.) is readied, having two oscillators of 50 kHz in oscillation frequency which are built therein in the state their phases are shifted by 180 degrees. Into its water tank, 3.3 L of ion-exchanged water is put, and 2 mL of CONTAMINON N is added to the water in this water tank.

(4) The beaker of the above (2) is set to a beaker fixing hole of the ultrasonic dispersion machine, and the ultrasonic dispersion machine is set working. Then, the height position of the beaker is so adjusted that the state of resonance of the liquid surface of the aqueous electrolytic solution in the beaker may become highest.

(5) In the state the aqueous electrolytic solution in the beaker of the above (4) is irradiated with ultrasonic waves, 10 mg of the toner is little by little added to the aqueous electrolytic solution and is dispersed therein. Then, such ultrasonic dispersion treatment is further continued for 60 seconds. In carrying out the ultrasonic dispersion treatment, the water temperature of the water tank is appropriately so controlled as to be 10° C. or more to 40° C. or less.

(6) To the round-bottomed beaker of the above (1), placed inside the sample stand, the aqueous electrolytic solution in which the toner has been dispersed in the above (5) is dropwise put in by using a pipette, and the measuring concentration is so adjusted as to be 5%. Then the measurement is made until the measuring particles come to 50,000 particles in number.

(7) The data of measurement are analyzed by using the above software attached to the measuring instrument for its exclusive use, to calculate the weight average particle diameter (D4) and number average particle diameter (D1). Here, "Average Diameter" on an "Analysis/Volume Statistic Value (Arithmetic Mean)" screen when set to graph/% by volume in the software for exclusive use is the weight average particle diameter (D4), and "Average Diameter" on an "Analysis/Number Statistic Value (Arithmetic Mean)" screen when set to graph/% by number in the software for exclusive use is the number average particle diameter (D1).

EXAMPLES

The present invention is described below by giving working examples. In the present working examples, "part(s)" refers to "part(s) by mass" in all occurrences.

Structural formulas of exemplary aromatic compounds usable in the present invention are shown in Table 1. About those in Table 1 which are used in Examples given later, their synthesis examples are subsequently described.

TABLE 1

| Aromatic compound | Structural formula | $R^1$ to $R^3$ H, OH, COOH, C1-C18 alkyl or alkoxyl group | $R^4$ to $R^7$ H, OH, C1-C18 alkyl or alkoxyl group | $R^8$ H or methyl group | m 1 to 3 |
|---|---|---|---|---|---|
| A | 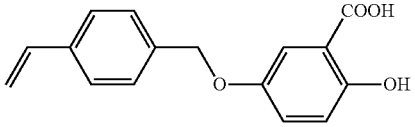 | H | H | H | 1 |
| B | 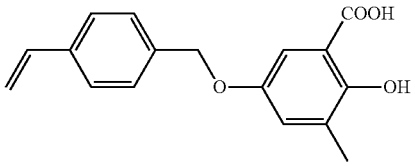 | 3-Me | H | H | 1 |
| C | 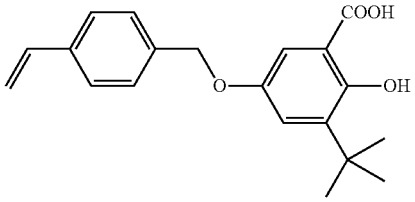 | 3-tert-Butyl | H | H | 1 |

TABLE 1-continued
| Aromatic compound | Structural formula | $R^1$ to $R^3$ H, OH, COOH, C1-C18 alkyl or alkoxyl group | $R^4$ to $R^7$ H, OH, C1-C18 alkyl or alkoxyl group | $R^8$ H or methyl group | m 1 to 3 |
|---|---|---|---|---|---|
| D | 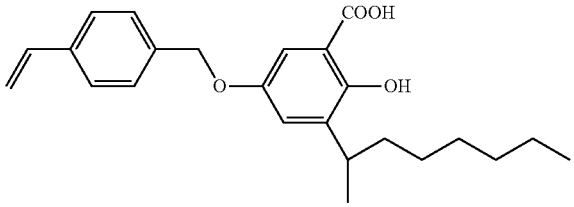 | 3-iso-Octyl | H | H | 1 |
| E | 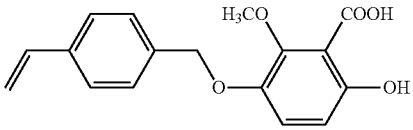 | 6-MeO | H | H | 1 |
| F | 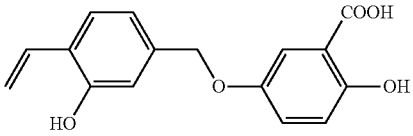 | H | 3-OH | H | 1 |
| G | 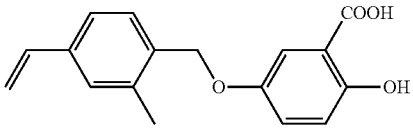 | H | 2-Me | H | 1 |
| H | 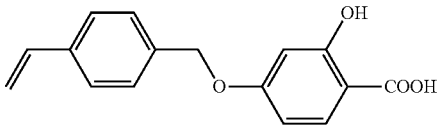 | H | H | H | 1 |
| I | 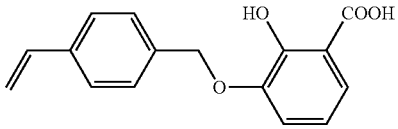 | H | H | H | 1 |
| J | 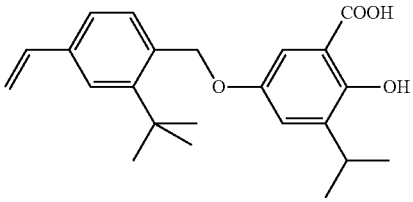 | 3-iso-Propyl | 2-tert-Butyl | H | 1 |
| K | 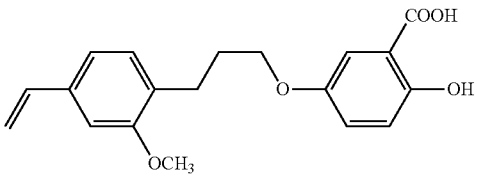 | H | 2-Me | H | 3 |

TABLE 1-continued

| Aromatic compound | Structural formula | $R^1$ to $R^3$ H, OH, COOH, C1-C18 alkyl or alkoxyl group | $R^4$ to $R^7$ H, OH, C1-C18 alkyl or alkoxyl group | $R^8$ H or methyl group | m 1 to 3 |
|---|---|---|---|---|---|
| L | 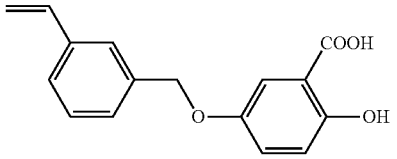 Mixture with A. | H | H | H | 1 |

Synthesis Example of Aromatic Compound A 100.0 g of 2,5-dihydroxybenzoic acid was dissolved in 2 L of methanol. To the solution formed, 88.3 g of potassium carbonate was added, and the mixture was heated to 67° C. To the reaction solution obtained, 102.0 g of 4-(chloromethyl) styrene was dropwise added over a period of 22 minutes, and the reaction was carried out at 67° C. for 12 hours. The reaction solution obtained was cooled and thereafter the methanol was evaporated off under reduced pressure, followed by washing with hexane. The residue formed was dissolved in methanol. The solution formed was re-precipitated in water, and the precipitate obtained was filtered. This operation of re-precipitation was repeated twice, and the residue formed was dried at 80° C. for 48 hours to obtain 48.7 g of a compound A represented by the following formula (2).

Formula (2)

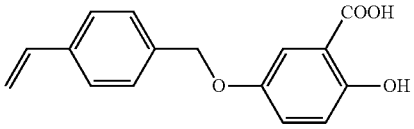

Synthesis Example of Aromatic Compound C

Step 1:

100 g of 2,5-dihydroxybenzoic acid and 1,441 g of 80% sulfuric acid were heated to 50° C. and mixed. To the liquid dispersion obtained, 144 g of tert-butyl alcohol was added, and the mixture was stirred at 50° C. for 30 minutes. Thereafter, the operation that 144 g of tert-butyl alcohol was added to the liquid dispersion and the mixture was stirred for 30 minutes was carried out three times. The reaction solution obtained was cooled to room temperature, and then dropwise added to 1 kg of ice water, where the precipitate formed was filtered, which was then washed with water and further washed with hexane. The precipitate formed was dissolved in 200 mL of methanol, and the solution obtained was re-precipitated in 3.6 L of water. After filtration, the product was dried at 80° C. to obtain 74.9 g of a salicylic acid intermediate represented by the following formula (3).

Formula (3)

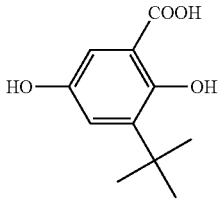

Step 2:

25.0 g of the salicylic acid intermediate obtained in the step 1 was dissolved in 150 mL of methanol. To the solution formed, 36.9 g of potassium carbonate was added, and the mixture was heated to 65° C. To the reaction solution obtained, a solution prepared by mixing and dissolving 18.7 g of 4-(chloromethyl)styrene in 100 mL of methanol was dropwise added, and the reaction was carried out at 65° C. for 3 hours. The reaction solution obtained was cooled and thereafter filtered. Then, the methanol in the filtrate formed was evaporated off under reduced pressure to obtain a precipitate. This precipitate was dispersed in 1.5 L of water with a pH of 2, followed by addition of ethyl acetate to carry out extraction. After washing with water, the extract obtained was dried with magnesium sulfate, and then the ethyl acetate was evaporated off under reduced pressure to obtain a precipitate. This precipitate was washed with hexane, and thereafter re-crystallized with toluene and ethyl acetate to obtain 20.1 g of a compound C represented by the following formula (4).

Formula (4)

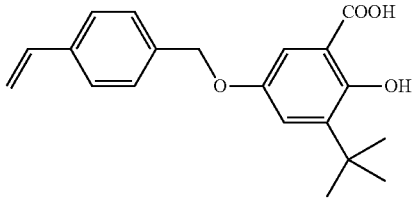

Synthesis Example of Aromatic Compound D

A compound D represented by the following formula (5) was obtained in the same way as Synthesis Example of Aromatic Compound A except that, in Synthesis Example of Aromatic Compound A, the 2,5-dihydroxybenzoic acid was changed for 173.2 g of 3,6-dihydroxy-5-isooctylbenzoic acid.

Formula (5)

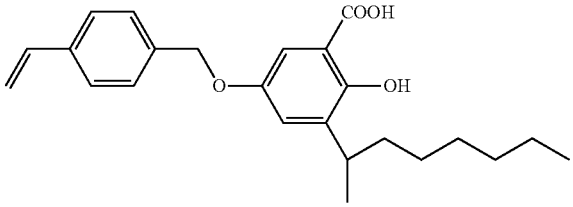

Synthesis Example of Aromatic Compound E

A compound E represented by the following formula (6) was obtained in the same way as Synthesis Example of Aromatic Compound A except that, in Synthesis Example of Aromatic Compound A, the 2,5-dihydroxybenzoic acid was changed for 119.5 g of 3,6-dihydroxy-2-methoxybenzoic acid.

Formula (6)

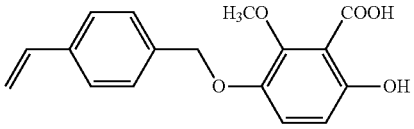

Synthesis Example of Aromatic Compound H

A compound H represented by the following formula (7) was obtained in the same way as Synthesis Example of Aromatic Compound A except that, in Synthesis Example of Aromatic Compound A, the 2,5-dihydroxybenzoic acid was changed for 2,4-dihydroxybenzoic acid.

Formula (7)

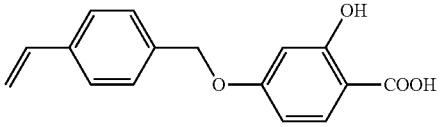

Synthesis Example of Aromatic Compound I

A compound I represented by the following formula (8) was obtained in the same way as Synthesis Example of Aromatic Compound A except that, in Synthesis Example of Aromatic Compound A, the 2,3-dihydroxybenzoic acid was changed for 2,5-dihydroxybenzoic acid.

Formula (8)

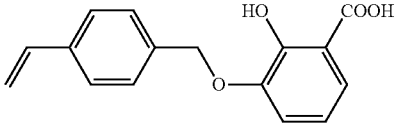

Synthesis Example of Aromatic Compound L 78.6 g of 2,5-dihydroxybenzoic acid was dissolved in 400 mL of methanol. To the solution formed, 152.0 g of potassium carbonate was added, and the mixture was stirred at 60° C. for 30 minutes. To the mixture obtained, 83.5 g of chloromethylstyrene (trade name: CMS-P; available from AGC Seimi Chemical Co., Ltd.) having been dissolved in 50 mL of methanol was dropwise added over a period of 1 hour. The reaction was carried out for 3 hours under reflux. After the reaction, the reaction solution obtained was cooled to room temperature, and the precipitate formed was filtered, and thereafter washed with methanol. The resultant precipitate was dispersed in 1 L of water, and the pH of the liquid dispersion formed was adjusted to 1 with hydrochloric acid, followed by stirring for 30 minutes. Thereafter, the mixture obtained was filtered, then washed with water, and then dried at 80° C. for 48 hours to obtain 76.2 g of a white solid which was a mixture of a compound represented by the following formula (9) and the compound represented by the formula (2).

Formula (9)

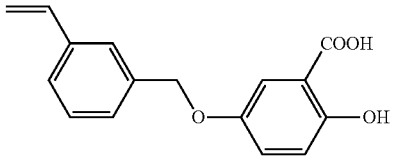

Next, synthesis examples of resins used in Examples are shown below. Constitution and physical properties of the resins obtained are shown in Table 2.

Synthesis Example of Polyester PES-1

| | |
|---|---|
| Bisphenol-A propylene oxide 2.2-mole addition product | 67.8 parts |
| Terephthalic acid | 22.2 parts |
| Trimellitic anhydride | 10.0 parts |
| Dibutyltin oxide | 0.005 part |

The above materials were put into a four-necked flask, and then a thermometer, a stirring rod, a condenser and a nitrogen feed tube were attached thereto, where, in an atmosphere of nitrogen, the reaction was carried out at 220° C. for 5 hours to obtain a polyester resin PES-1.

Synthesis Example of Polyester PES-2

| | |
|---|---|
| Bisphenol-A propylene oxide 2.2-mole addition product | 68.0 parts |
| Terephthalic acid | 28.0 parts |
| Trimellitic anhydride | 4.0 parts |
| Dibutyltin oxide | 0.005 part |

The above materials were put into a four-necked flask, and then a thermometer, a stirring rod, a condenser and a nitrogen feed tube were attached thereto, where, in an atmosphere of nitrogen, the reaction was carried out at 220° C. for 5 hours to obtain a polyester resin PES-2.

Synthesis Example of Polyester PES-3

| | |
|---|---|
| Bisphenol-A propylene oxide 2.2-mole addition product | 67.0 parts |
| Terephthalic acid | 18.0 parts |
| Trimellitic anhydride | 15.0 parts |
| Dibutyltin oxide | 0.005 part |

The above materials were put into a four-necked flask, and then a thermometer, a stirring rod, a condenser and a nitrogen feed tube were attached thereto, where, in an atmosphere of nitrogen, the reaction was carried out at 220° C. for 5 hours to obtain a polyester resin PES-3.

Synthesis Example of Polyester PES-4

| | |
|---|---|
| Bisphenol-A propylene oxide 2.2-mole addition product | 66.0 parts |
| Terephthalic acid | 9.0 parts |
| Dimethyl terephthalate | 25.0 parts |
| Dibutyltin oxide | 0.005 part |

The above materials were put into a four-necked flask made of glass. Then, a thermometer, a stirring rod, a condenser and a nitrogen feed tube were attached thereto, and this flask was placed in a mantle heater. In an atmosphere of nitrogen, the reaction was carried out at 220° C. for 5 hours to obtain a polyester resin PES-4.

Synthesis Example of Polyester PES-5

| | |
|---|---|
| Bisphenol-A propylene oxide 2.2-mole addition product | 65.0 parts |
| Terephthalic acid | 3.0 parts |
| Dimethyl terephthalate | 32.0 parts |
| Dibutyltin oxide | 0.005 part |

The above materials were put into a 4-L four-necked flask made of glass. Then, a thermometer, a stirring rod, a condenser and a nitrogen feed tube were attached thereto, and this flask was placed in a mantle heater. In an atmosphere of nitrogen, the reaction was carried out at 220° C. for 5 hours to obtain a polyester resin PES-5.

Synthesis Example of Polyester PES-6

| | |
|---|---|
| Bisphenol-A propylene oxide 2.2-mole addition product | 64.5 parts |
| Terephthalic acid | 1.5 parts |
| Dimethyl terephthalate | 34.0 parts |
| Dibutyltin oxide | 0.005 part |

The above materials were put into a 4-L four-necked flask made of glass. Then, a thermometer, a stirring rod, a condenser and a nitrogen feed tube were attached thereto, and this flask was placed in a mantle heater. In an atmosphere of nitrogen, the reaction was carried out at 220° C. for 5 hours to obtain a polyester resin PES-6.

Synthesis Example of Polyester PES-7

| | |
|---|---|
| Bisphenol-A propylene oxide 2.2-mole addition product | 66.0 parts |
| Terephthalic acid | 21.0 parts |
| Trimellitic anhydride | 13.0 parts |
| Dibutyltin oxide | 0.005 part |

The above materials were put into a four-necked flask, and then a thermometer, a stirring rod, a condenser and a nitrogen feed tube were attached thereto, where, in an atmosphere of nitrogen, the reaction was carried out at 220° C. for 5 hours to obtain a polyester resin PES-7.

Synthesis Example of Polyester PES-8

| | |
|---|---|
| Bisphenol-A propylene oxide 2.2-mole addition product | 65.0 parts |
| Terephthalic acid | 19.0 parts |
| Trimellitic anhydride | 16.0 parts |
| Dibutyltin oxide | 0.005 part |

The above materials were put into a four-necked flask, and then a thermometer, a stirring rod, a condenser and a nitrogen feed tube were attached thereto, where, in an atmosphere of nitrogen, the reaction was carried out at 220° C. for 5 hours to obtain a polyester resin PES-8.

Synthesis Example of Styrene Acrylic Resin SA-1

Into a reaction vessel provided with a stirrer, a condenser, a thermometer and a nitrogen feed tube, 200 parts of xylene was fed, and was refluxed in a stream of nitrogen.

| | |
|---|---|
| Styrene | 78.6 parts |
| n-Butyl acrylate | 20.0 parts |
| Acrylic acid | 1.4 parts |
| Dimethyl-2,2'-azobis(2-methylrpopionate) | 5.0 parts |

Next, the above materials were mixed, and the mixture obtained was dropwise fed into the above reaction vessel with stirring, which was retained for 10 hours. Thereafter, distillation was carried out and the solvent was evaporated off, followed by drying at 40° C. under reduced pressure to obtain a styrene acrylic resin SA-1.

Synthesis Example of Styrene Acrylic Resin SA-2

A styrene acrylic resin SA-2 was obtained in the same way as Synthesis Example of Styrene Acrylic Resin SA-1 except that the following materials were used instead.

| | |
|---|---|
| Styrene | 78.0 parts |
| n-Butyl acrylate | 20.0 parts |
| Methacrylic acid | 2.0 parts |
| Dimethyl-2,2'-azobis(2-methylrpopionate) | 5.0 parts |

Synthesis Example of Styrene Acrylic Resin SA-3

A styrene acrylic resin SA-3 was obtained in the same way as Synthesis Example of Styrene Acrylic Resin SA-1 except that the following materials were used instead.

| | |
|---|---|
| Styrene | 75.0 parts |
| n-Butyl acrylate | 19.0 parts |
| Methacrylic acid | 1.4 parts |
| 2-Hydroxyethyl methacrylate | 4.6 parts |
| Dimethyl-2,2'-azobis(2-methylrpopionate) | 5.0 parts |

Synthesis Example of Hybrid Resin HB-1

| | |
|---|---|
| Bisphenol-A propyleneoxide 2.2-mole addition product | 69.0 parts |
| Terephthalic acid | 28.0 parts |
| Fumaric acid | 3.0 parts |
| Dibutyltin oxide | 0.005 part |

The above materials were put into a four-necked flask, and then a thermometer, a stirring rod, a condenser and a nitrogen feed tube were attached thereto, where, in an atmosphere of nitrogen, the reaction was carried out at 220° C. for 5 hours to obtain a polyester resin.

Into a reaction vessel provided with a stirrer, a condenser, a thermometer and a nitrogen feed tube, 200 parts of xylene was fed, and was refluxed in a stream of nitrogen. Then, 70 parts of the polyester resin produced previously was fed thereto and dissolved.

| | |
|---|---|
| Styrene | 79.0 parts |
| n-Butyl acrylate | 20.3 parts |
| Acrylic acid | 0.7 part |
| Dimethyl-2,2'-azobis(2-methylrpopionate) | 1.5 parts |

Next, the above materials were mixed, and the mixture obtained was dropwise fed into the above reaction vessel with stirring, which was retained for 10 hours. Thereafter, distillation was carried out and the solvent was evaporated off, followed by drying at 40° C. under reduced pressure to obtain a hybrid resin HB-1.

TABLE 2

| | Constitution of resin prepared | | | | | | | | | | |
|---|---|---|---|---|---|---|---|---|---|---|---|
| | Polyester resin component | | | | | | | | | | |
| | Polyester monomer component (mol %) | | | Vinyl resin component | | | | Physical properties of resin prepared | | | |
| | | | | Vinyl resin monomer component (mol %) | | | | Acid | Hydroxyl | Molecular weight | |
| | Polyhydric alcohol component | Polybasic carboxylic acid component | Content (ms. %) | Styrene | n-BA | other | Content (ms. %) | value mgKOH/g | value mgKOH/g | Mw | Mn |
| PES-1 | BPA(PO) 49.9 | TPA/TMA 35.5/13.9 | 100 | — | — | — | — | 12.12 | 3.20 | 17100 | 6300 |
| PES-2 | BPA(PO) 50.2 | TPA/TMA 44.3/5.5 | 100 | — | — | — | — | 5.50 | 12.28 | 14100 | 4800 |
| PES-3 | BPA(PO) 50.2 | TPA/TMA 28.9/20.9 | 100 | — | — | — | — | 25.05 | 2.52 | 16300 | 5600 |
| PES-4 | BPA(PO) 50.3 | TPA/DMTPA 14.7/35.0 | 100 | — | — | — | — | 4.23 | 18.70 | 12200 | 5700 |
| PES-5 | BPA(PO) 50.0 | TPA/DMTPA 4.9/45.1 | 100 | — | — | — | — | 2.39 | 22.14 | 13600 | 6000 |
| PES-6 | BPA(PO) 49.6 | TPA/DMTPA 2.5/47.9 | 100 | — | — | — | — | 1.01 | 21.81 | 13000 | 5900 |
| PES-7 | BPA(PO) 48.9 | TPA/TMA 33.3/17.8 | 100 | — | — | — | — | 55.24 | 1.51 | 14100 | 6300 |
| PES-8 | BPA(PO) 48.0 | TPA/TMA 30.1/21.9 | 100 | — | — | — | — | 65.92 | 0.84 | 13900 | 5900 |
| SA-1 | — | — | — | 81.1 | 16.8 | AA 2.1 | 100 | 10.55 | — | 18200 | 9200 |
| SA-2 | — | — | — | 80.7 | 16.8 | MAA 2.5 | 100 | 12.22 | — | 17900 | 8100 |
| SA-3 | — | — | — | 78.0 | 16.1 | AA/2-HEMA 2.1/3.8 | 100 | 10.20 | 19.13 | 20200 | 9600 |
| HB-1 | BPA(PO) 49.9 | TPA/FMA 43.4/6.7 | 70 | 81.9 | 17.1 | AA 1.0 | 30 | 14.67 | 13.29 | 16500 | 10400 |

Toners 1 to 48 were produced by the method shown below.

Example 1

| | |
|---|---|
| Polyester resin PES-1 | 100.0 parts |
| Aromatic compound A | 3.0 parts |
| Copper phthalocyanine (C.I. Pigment Blue 15:3, available from Dainichiseika Color & Chemicals Co., Ltd.) | 5.0 parts |
| Paraffin wax (HNP-7, available from Nippon Seiro Co., Ltd.) | 3.0 parts |

The above materials were sufficiently pre-mixed by means of Henschel mixer (manufactured by Mitsui Miike Engineering Corporation), and thereafter the mixture obtained was melt-kneaded by means of a twin-screw extruder. The kneaded product obtained was cooled, and then crushed by using a hammer mill to a size of approximately from 1 mm to 2 mm. The crushed product obtained was then finely pulverized by means of a fine grinding machine of an air jet system. Further, the finely pulverized product obtained was classified by means of a multi-division classifier to obtain toner particles.

To 100 parts of the above toner particles (toner base particles), 1.0 part of hydrophobic fine silica powder having a BET specific surface area of 200 $m^2/g$ was externally added by means of Henschel mixer to obtain a toner 1. Physical properties of the toner of this Example are shown in Table 3. Also, the toner was evaluated as in the following. The results of evaluation are also shown in Table 3.

Evaluation of Toner Charge Quantity

A two-component developer was produced in the following way.

To evaluate the charge quantity, a sample was prepared in the following way. 276 g of a ferrite carrier F813-300 (available from Powdertech Co.) and 24 g of the toner to be evaluated were put into a lidded plastic bottle, and this was shook by means of a shaker (YS-LD, manufactured by K.K. Yayoi) for 1 minute at a speed of shaking back and forth four times at intervals of 1 second.

Evaluation of toner charge quantity in high-temperature and high-humidity environment:

To measure the charge quantity, 30 g of the two-component developer was dispensed, and was left to stand overnight for 3 days in a high-temperature and high-humidity environment (30° C./80% RH, "HH"). Thereafter, this was put into a 50 cc plastic bottle, which was then put to shaking 500 times at a speed of 200 times/minute, and the charge quantity was measured with an instrument shown in FIGURE. It was evaluated by measuring saturated charge quantity and making judgment according to the following criteria.

Rank A: −30.0 mC/kg or less.

Rank B: −20.0 mC/kg or less to more than −30.0 mC/kg.

Rank C: −10.0 mC/kg or less to more than −20.0 mC/kg.

Rank D: More than −10.0 mC/kg.

How to Measure Charge Quantity:

0.500 g of the developer the triboelectric charge quantity of which was to be measured was put into a measuring container 2 shown in FIGURE, which was made of a metal and to the bottom of which a screen 3 of 500 meshes (mesh opening: 25 μm) was attached, and the container was covered with a lid 4 made of a metal. The total mass of the measuring container 2 at this point was expressed as W1 (g). Next, in a suction device 1 (made of an insulating material at least at the part coming into contact with the measuring container 2), air was sucked from a suction opening 7 and an air-flow control valve 6 was operated to control the pressure indicated by a vacuum indicator 5, to be 250 mmAq. In this state, suction was sufficiently carried out, preferably for 2 minutes, to remove the developer by suction.

The potential indicated by an electrometer 9 at this point was expressed as V (volt). Here, reference numeral 8 denotes a capacitor, whose capacitance was expressed as C (μF). The total mass of the measuring container after the suction was expressed as W2 (g). The triboelectric charge quantity (mC/kg) of this developer was calculated according to the following expression.

$$\text{Triboelectric charge quantity (mC/kg)} = (C \times V)/(W1 - W2).$$

Evaluation of Environmental Dependence of Charge Quantity of Toner:

Toner charge quantity was measured in the same way as the above method described in evaluating the toner charge quantity in the high-temperature and high-humidity environment except that the developer was left to stand in a low-temperature and low-humidity environment (15° C./15% RH, "LL"). To make evaluation, a value of the ratio of charge quantity in the low-temperature and low-humidity environment to that in the high-temperature and high-humidity environment (charge quantity in low-temperature and low-humidity environment/charge quantity in high-temperature and high-humidity environment; LL/HH ratio) was calculated as environmental difference of saturated charge quantity to make judgment according to the following criteria.

Rank A: Less than 1.30.

Rank B: 1.30 or more to less than 1.50.

Rank C, 1.50 or more to less than 2.00.

Rank D: 2.00 or more.

Evaluation of Charging Rise Performance of Toner:

270 g of the two-component developer was dispensed, and was left to stand overnight for 3 days in a high-temperature and high-humidity environment (30° C./80% RH, "HH"). This developer was loaded into a developing assembly of a color laser copying machine CLC5500 (manufactured by CANON INC.), and this developing assembly was idled at 240 rpm by using an idling equipment having an external motor. At the time that it was idled for 2 minutes (Q2 min) and at the time that it was idled for further 3 minutes (Q5 min), the two-component developer on the developing sleeve was collected for each, and each charge quantity thereon was measured with the instrument shown in FIGURE. To make evaluation, the value of Q5 min/Q2 min was calculated to make judgment according to the following criteria.

Rank A: Less than 1.20.

Rank B: 1.20 or more to less than 1.40.

Rank C, 1.40 or more to less than 1.60.

Rank D: 1.60 or more.

Examples 2 to 22

The procedure of Example 1 was repeated to obtain toners 2 to 22, except that their formulation was changed as shown in Table 3. Using the toners obtained, evaluation was made in the same way as Example 1 to obtain the results of evaluation as shown in Table 3.

Example 23

Preparation of Toner Composition Liquid Mixture

| | |
|---|---|
| Styrene-n-butyl acrylate copolymer (Tg: 58° C.; Mw: 22,000) | 100.0 parts |
| Aromatic compound A | 3.3 parts |
| Copper phthalocyanine (C.I. Pigment Blue 15:3, available from Dainichiseika Color & Chemicals Co., Ltd.) | 5.0 parts |
| Paraffin wax (HNP-7, available from Nippon Seiro Co., Ltd.) | 8.0 parts |
| Polyester resin PES-1 | 7.5 parts |
| Ethyl acetate | 100.0 parts |

The above materials were sufficiently pre-mixed in a container, and thereafter the mixture obtained was, as it was kept at 20° C., put to dispersion for 4 hours by means of a bead mill to prepare a toner composition liquid mixture.

Production of Toner Particles:

Into 240 parts of ion-exchanged water, 78 parts of an aqueous 0.1 mol/L $Na_3PO_4$ solution was introduced, followed by heating to 60° C. and then stirring at 14,000 rpm by means of a homomixer CLEAMIX (manufactured by $M_{TECHNIQUE}$ Co., Ltd.). To the resultant mixture, 12 parts of an aqueous 1.0 mol/L $CaCl_2$ solution was added to obtain a dispersion medium containing $Ca_3(PO_4)_2$. Further, 1.0 part of carboxymethyl cellulose (trade name: CELLOGEN BS-H, available from Dai-ichi Kogyo Seiyaku Co., Ltd.) was added, and the mixture obtained was stirred for 10 minutes.

The dispersion medium prepared in a container of the above homomixer was controlled to 30° C., and, to the dispersion medium, while being stirred, 180 parts of the toner composition liquid mixture, having been controlled to 30° C., was introduced, which were then stirred for 1 minute and thereafter stopped being stirred to obtain a toner composition disperse suspension. The toner composition disperse suspension obtained was stirred, during which, constantly at 40° C., the gaseous phase on the suspension liquid level was forcedly renewed by means of an exhaust system, where this was kept for 17 hours as it was, and the solvent was removed. This was cooled to room temperature, and hydrochloric acid was added thereto to dissolve the $Ca_3(PO_4)_2$, followed by filtration, water washing, drying and then classification to obtain toner particles. To the toner particles (toner base particles) obtained, hydrophobic fine silica powder was externally added in the same way as Example 1 to obtain a toner 23.

Using the toner obtained, evaluation was made in the same way as Example 1 to obtain the results of evaluation as shown in Table 3.

Example 24

Preparation of Resin Liquid Dispersion

| | |
|---|---|
| Styrene | 78.0 parts |
| n-Butyl acrylate | 20.0 parts |
| Methacrylic acid | 2.0 parts |
| Dodecane thiol | 6.0 parts |
| Carbon tetrabromide | 1.0 part |

In a flask, 1.5 parts of a nonionic surface-active agent NONIPOL 400 (available from Daiichi Kogyo Seiyaku Co., Ltd.) and 2.5 parts of an anionic surface-active agent NEOGEN SC (available from Daiichi Kogyo Seiyaku Co., Ltd.) were dissolved in 140 parts of ion-exchanged water. The above materials were mixed and dissolved to prepare a solution, which was then added to the solution held in the flask, and dispersed and emulsified therein, where 10 parts of ion-exchanged water in which 1.0 part of ammonium persulfate was dissolved was introduced thereinto with slow mixing for 10 minutes. Then, while displacing inside atmosphere with nitrogen, the flask was heated using an oil bath until the contents reached 70° C., where emulsification polymerization was continued for 5 hours as it was. Thus, a resin liquid dispersion was obtained which had a center particle diameter of 145 nm, a glass transition point of 58° C. and an Mw of 11,200.

Preparation of Blue Pigment Liquid Dispersion

What was composed as shown below was put to dispersion by means of a homogenizer (ULTRATALUX T50, manufactured by IKA Japan K.K.) and by ultrasonic irradiation to obtain a blue pigment liquid dispersion having a center particle diameter of 140 nm.

| | |
|---|---|
| Copper phthalocyanine (C.I. Pigment Blue 15:3, available from Dainichiseika Color & Chemicals Co., Ltd.) | 100.0 parts |
| Aromatic compound A | 62.0 parts |
| Anionic surface-active agent NEOGEN SC | 10.0 parts |
| Ion-exchanged water | 400.0 parts |

Preparation of Release Agent Liquid Dispersion:

What was composed as shown below was mixed, and the mixture obtained was heated to 97° C. and thereafter put to dispersion by means of the homogenizer ULTRATALUX T50, manufactured by IKA Japan K.K. Thereafter, the mixture obtained was put to dispersion treatment by using Gaulin homogenizer (available from Meiwafosis Co., Ltd.), which was treated 20 times under conditions of 105° C. and 550 kg/cm$^2$ to obtain a release agent liquid dispersion having a center particle diameter of 190 nm.

| | |
|---|---|
| Paraffin wax (HNP-7, available from Nippon Seiro Co., Ltd.) | 100.0 parts |
| Anionic surface-active agent NEOGEN SC | 5.0 parts |
| Ion-exchanged water | 300.0 parts |

Production of Toner Particles:

| | |
|---|---|
| Resin liquid dispersion (resin particles solid content: 25.0% by mass) | 400.0 parts |
| Blue pigment liquid dispersion (aromatic compound A content: 11.0% by mass) | 28.6 parts |
| Release agent liquid dispersion | 30.0 parts |
| Cationic surface-active agent SANIZOLE B50 (available from Kao Corporation) | 2.0 parts |

The above was mixed and dispersed by means of the homogenizer ULTRATALUX T50 in a round-bottomed flask made of stainless steel, and thereafter the contents of the flask were heated to 48° C. with stirring in a heating oil bath. The mixture obtained was retained at 48° C. for 30 minutes, and thereafter the temperature of the heating oil bath was raised to retain the mixture at 50° C. for 1 hour. Thereafter, to the resultant mixture, 3 parts of NEOGEN SC was added, and thereafter the flask made of stainless steel was hermetically closed, and, with stirring continued by using a magnetic seal, heated to 105° C., which was retained for 3 hours. Then, after cooling, the reaction product obtained was filtered, and washed sufficiently with ion-exchanged water, followed by drying and then classification to obtain toner particles. Further, to the toner particles (toner base particles) obtained, hydrophobic fine silica powder was externally added in the same way as Example 1 to obtain a toner 24.

Using the toner obtained, evaluation was made in the same way as Example 1 to obtain the results of evaluation as shown in Table 3.

Example 25

The procedure of Example 1 was repeated to obtain a toner 25, except that the copper phthalocyanine (C.I. Pigment Blue 15:3) was changed for carbon black (trade name: NIPEX 30, available from Degussa Corp.). Using the toner obtained, evaluation was made in the same way as Example 1 to obtain the results of evaluation as shown in Table 3.

Example 26

The procedure of Example 1 was repeated to obtain a toner 26, except that the copper phthalocyanine (C.I. Pigment Blue 15:3) was changed for C.I. Pigment Violet 19. Using the toner obtained, evaluation was made in the same way as Example 1 to obtain the results of evaluation as shown in Table 3.

Example 27

| | |
|---|---|
| Styrene-n-butyl acrylate copolymer (Tg: 57° C.; Mw: 21,000) | 100.0 parts |
| Aromatic compound A | 3.1 parts |
| Copper phthalocyanine (C.I. Pigment Blue 15:3, available from Dainichiseika Color & Chemicals Co., Ltd.) | 5.0 parts |
| Paraffin wax (HNP-7, available from Nippon Seiro Co., Ltd.) | 3.0 parts |
| Boron benzilate compound LR-147 (available from The Japan Carlit Co., Ltd.) | 1.6 parts |

The above toner materials were sufficiently pre-mixed by means of Henschel mixer (manufactured by Mitsui Miike Engineering Corporation), and thereafter the mixture obtained was melt-kneaded by means of a twin-screw extruder. The kneaded product obtained was cooled, and then crushed by using a hammer mill to a size of approximately from 1 mm to 2 mm. The crushed product obtained was then finely pulverized by means of a fine grinding machine of an air jet system. Further, the finely pulverized product obtained was classified by means of a multi-division classifier to obtain toner particles.

To 100 parts of the above toner particles (toner base particles), 1.0 part of hydrophobic fine silica powder having a BET specific surface area of 200 $m^2/g$ was externally added by means of Henschel mixer to obtain a toner 27. Physical properties and evaluation results of the toner obtained are shown in Table 4.

Examples 28 to 33 & 35 to 41

The procedure of Example 27 was repeated to obtain toners 28 to 33 and 35 to 41, except that their formulation was changed as shown in Table 4. Using the toners obtained, evaluation was made in the same way as Example 1 to obtain the results of evaluation as shown in Table 4.

Example 34

The procedure of Example 27 was repeated to obtain a toner 34, except that its formulation was changed as shown below.

| | |
|---|---|
| Polyester resin PES-1 | 100 parts |
| Aromatic compound A | 3.1 parts |
| Carbon black (trade name: NIPEX 30, available from Degussa Corp.) | 5.0 parts |
| Monoazo iron complex (T-77, available from Hodogaya Chemical Co., Ltd.) | 1.5 parts |
| Paraffin wax (HNP-7, available from Nippon Seiro Co., Ltd.) | 3.0 parts |

Using the toner obtained, evaluation was made in the same way as Example 1 to obtain the results of evaluation as shown in Table 4.

Example 42

The procedure of Example 23 was repeated to obtain a toner 42, except that 1.6 parts of a boron benzilate compound LR-147 (available from The Japan Carlit Co., Ltd.) was added to the toner composition liquid mixture. Using the toner obtained, evaluation was made in the same way as Example 1 to obtain the results of evaluation as shown in Table 4.

Example 43

The procedure of Example 27 was repeated to obtain a toner 43, except that the copper phthalocyanine (C.I. Pigment Blue 15:3) was changed for carbon black (trade name: NIPEX 30, available from Degussa Corp.). Using the toner obtained, evaluation was made in the same way as Example 1 to obtain the results of evaluation as shown in Table 4.

Example 44

The procedure of Example 27 was repeated to obtain a toner 44, except that the copper phthalocyanine (C.I. Pigment Blue 15:3) was changed for C.I. Pigment Violet 19. Using the toner obtained, evaluation was made in the same way as Example 1 to obtain the results of evaluation as shown in Table 4.

Comparative Example 1

The procedure of Example 1 was repeated to obtain a toner 45, except that the aromatic compound A was not used. Using the toner obtained, evaluation was made in the same way as Example 1 to obtain the results of evaluation as shown in Table 4.

Comparative Example 2

The procedure of Example 1 was repeated to obtain a toner 46, except that the polyester resin PES-1 was changed for a styrene-n-butyl acrylate copolymer (Tg: 57° C.; Mw: 21,000). Using the toner obtained, evaluation was made in the same way as Example 1 to obtain the results of evaluation as shown in Table 4.

Comparative Example 3

The procedure of Example 27 was repeated to obtain a toner 47, except that the aromatic compound A was not used. Using the toner obtained, evaluation was made in the same way as Example 1 to obtain the results of evaluation as shown in Table 4.

Comparative Example 4

The procedure of Example 34 was repeated to obtain a toner 48, except that the aromatic compound A was not used. Using the toner obtained, evaluation was made in the same way as Example 1 to obtain the results of evaluation as shown in Table 4.

TABLE 3

| | | Toner summary | | | | |
|---|---|---|---|---|---|---|
| | | Type Feed (pbm) | Aromatic compound present in toner particles | Content a μmol/g | Charge-providing agent | Content μmol/g |
| Example 1 | Toner 1 | A 3.0 | 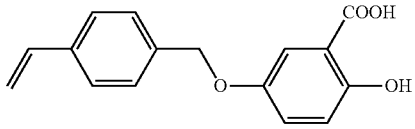 | 99.1 | — | — |
| Example 2 | Toner 2 | C 3.7 | 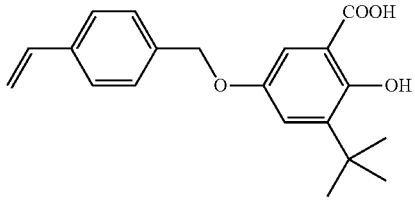 | 100.5 | — | — |
| Example 3 | Toner 3 | E 3.4 | 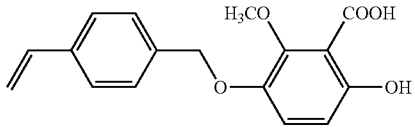 | 100.7 | — | — |
| Example 4 | Toner 4 | H 3.0 | 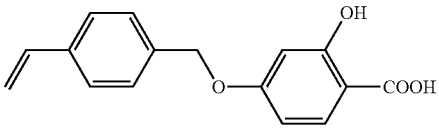 | 99.1 | — | — |
| Example 5 | Toner 5 | I 3.0 | 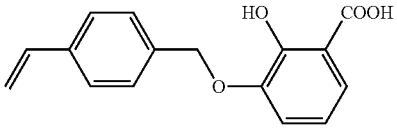 | 99.1 | — | — |
| Example 6 | Toner 6 | D 4.3 | 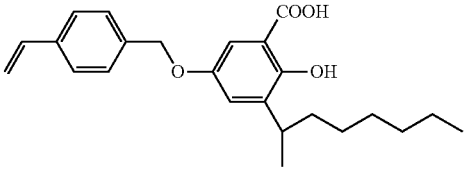 | 99.0 | — | — |
| Example 7 | Toner 7 | L 3.0 | 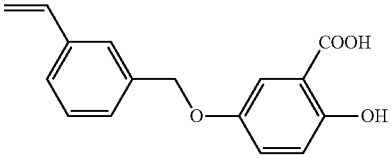 | 99.1 | — | — |
| Example 8 | Toner 8 | A 3.0 | 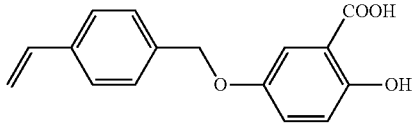 | 99.1 | — | — |

TABLE 3-continued
| | | | | | | |
|---|---|---|---|---|---|---|
| Example 9 | Toner 9 | A 3.0 | 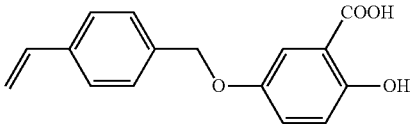 | 99.1 | — | — |
| Example 10 | Toner 10 | A 3.0 | 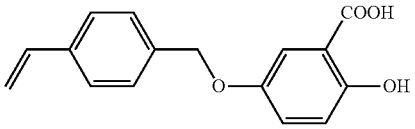 | 99.1 | — | — |
| Example 11 | Toner 11 | A 3.0 | 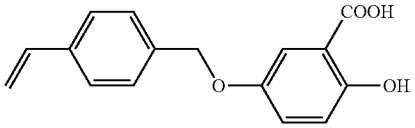 | 99.1 | — | — |
| Example 12 | Toner 12 | A 3.0 | 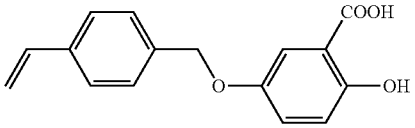 | 99.1 | — | — |
| Example 13 | Toner 13 | A 3.0 | 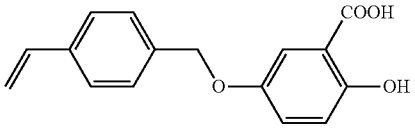 | 99.1 | — | — |
| Example 14 | Toner 14 | A 0.097 | 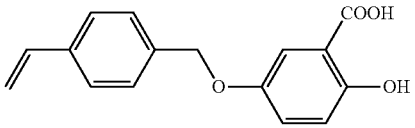 | 3.3 | — | — |
| Example 15 | Toner 15 | A 0.44 | 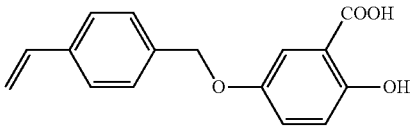 | 14.9 | — | — |
| Example 16 | Toner 16 | A 0.88 | 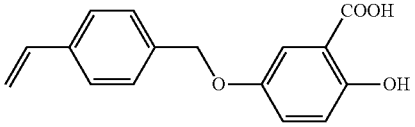 | 29.6 | — | — |
| Example 17 | Toner 17 | A 5.9 | 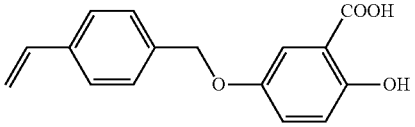 | 190.0 | — | — |
| Example 18 | Toner 18 | A 0.074 | 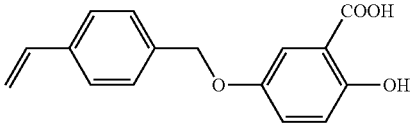 | 2.5 | — | — |
| Example 19 | Toner 19 | A 6.72 | 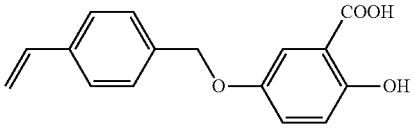 | 214.8 | — | — |

TABLE 3-continued

| | | | | | | |
|---|---|---|---|---|---|---|
| Example 20 | Toner 20 | A 3.0 | 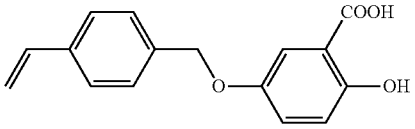 | 99.1 | — | — |
| Example 21 | Toner 21 | A 3.0 | 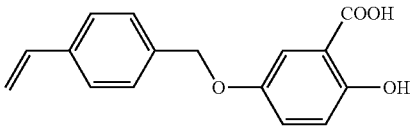 | 99.1 | — | — |
| Example 22 | Toner 22 | A 3.0 | 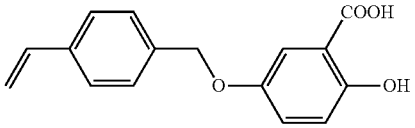 | 99.1 | — | — |
| Example 23 | Toner 23 | A 3.3 | 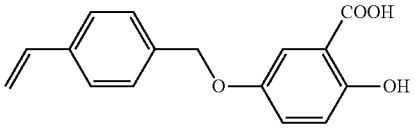 | 97.8 | — | — |
| Example 24 | Toner 24 | A 3.15 | 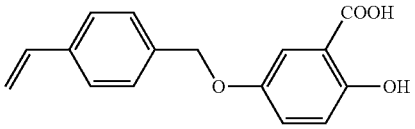 | 99.8 | — | — |
| Example 25 | Toner 25 | A 3.0 | 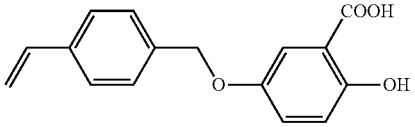 | 99.1 | — | — |
| Example 26 | Toner 26 | A 3.0 | 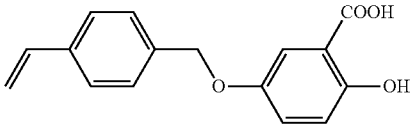 | 99.1 | — | — |

| | | Toner summary | | | | | | |
|---|---|---|---|---|---|---|---|---|
| | | Chief polar resin in toner particles | Resin acid value mgKOH/g | Feed pbm | Toner production process | Colorant | Toner particle surface acid value mgKOH/g | Toner particle diam. μm |
| Example 1 | Toner 1 | PES1 | 12.12 | 100 | Kneading pulverization | C.I. Pig. Blue 15:3 | 0.132 | 7.5 |
| Example 2 | Toner 2 | PES1 | 12.12 | 100 | Kneading pulverization | C.I. Pig. Blue 15:3 | 0.137 | 6.9 |
| Example 3 | Toner 3 | PES1 | 12.12 | 100 | Kneading pulverization | C.I. Pig. Blue 15:3 | 0.118 | 7.0 |
| Example 4 | Toner 4 | PES1 | 12.12 | 100 | Kneading pulverization | C.I. Pig. Blue 15:3 | 0.115 | 7.0 |
| Example 5 | Toner 5 | PES1 | 12.12 | 100 | Kneading pulverization | C.I. Pig. Blue 15:3 | 0.129 | 6.9 |
| Example 6 | Toner 6 | PES1 | 12.12 | 100 | Kneading pulverization | C.I. Pig. Blue 15:3 | 0.130 | 7.1 |
| Example 7 | Toner 7 | PES1 | 12.12 | 100 | Kneading pulverization | C.I. Pig. Blue 15:3 | 0.125 | 7.2 |
| Example 8 | Toner 8 | PES2 | 2.39 | 100 | Kneading pulverization | C.I. Pig. Blue 15:3 | 0.026 | 7.2 |
| Example 9 | Toner 9 | PES5 | 5.50 | 100 | Kneading pulverization | C.I. Pig. Blue 15:3 | 0.084 | 7.3 |
| Example 10 | Toner 10 | PES3 | 25.05 | 100 | Kneading pulverization | C.I. Pig. Blue 15:3 | 0.205 | 7.1 |
| Example 11 | Toner 11 | PES7 | 55.24 | 100 | Kneading pulverization | C.I. Pig. Blue 15:3 | 0.362 | 6.8 |
| Example 12 | Toner 12 | PES8 | 65.92 | 100 | Kneading pulverization | C.I. Pig. Blue 15:3 | 0.445 | 6.7 |

TABLE 3-continued

| | | | | | | | | |
|---|---|---|---|---|---|---|---|---|
| Example 13 | Toner 13 | PES6 | 1.01 | 100 | Kneading pulverization | C.I. Pig. Blue 15:3 | 0.013 | 6.9 |
| Example 14 | Toner 14 | PES1 | 12.12 | 100 | Kneading pulverization | C.I. Pig. Blue 15:3 | 0.103 | 7.2 |
| Example 15 | Toner 15 | PES1 | 12.12 | 100 | Kneading pulverization | C.I. Pig. Blue 15:3 | 0.111 | 6.8 |
| Example 16 | Toner 16 | PES1 | 12.12 | 100 | Kneading pulverization | C.I. Pig. Blue 15:3 | 0.122 | 7.2 |
| Example 17 | Toner 17 | PES1 | 12.12 | 100 | Kneading pulverization | C.I. Pig. Blue 15:3 | 0.134 | 7.3 |
| Example 18 | Toner 18 | PES1 | 12.12 | 100 | Kneading pulverization | C.I. Pig. Blue 15:3 | 0.112 | 7.0 |
| Example 19 | Toner 19 | PES4 | 4.23 | 100 | Kneading pulverization | C.I. Pig. Blue 15:3 | 0.092 | 6.8 |
| Example 20 | Toner 20 | SA1 | 10.55 | 100 | Kneading pulverization | C.I. Pig. Blue 15:3 | 0.074 | 6.8 |
| Example 21 | Toner 21 | SA3 | 10.20 | 100 | Kneading pulverization | C.I. Pig. Blue 15:3 | 0.069 | 6.9 |
| Example 22 | Toner 22 | HB1 | 14.67 | 100 | Kneading pulverization | C.I. Pig. Blue 15:3 | 0.201 | 7.3 |
| Example 23 | Toner 23 | PES1 | 12.12 | 7.5 | Dissoln suspension | C.I. Pig. Blue 15:3 | 0.198 | 7.3 |
| Example 24 | Toner 24 | SA2 | 12.22 | 100 | Emulsn agglomeration | C.I. Pig. Blue 15:3 | 0.153 | 6.5 |
| Example 25 | Toner 25 | SA2 | 12.22 | 5.0 | Kneading pulverization | CB | 0.180 | 6.5 |
| Example 26 | Toner 26 | SA2 | 12.22 | 5.0 | Kneading pulverization | C.I. Pig. Violet 19 | 0.175 | 6.4 |

| | | Evaluation results | | | | | |
|---|---|---|---|---|---|---|---|
| | | Saturated charge quantity in HH | | Environmental difference of saturated charge quantity | | Toner charging rise on developing sleeve in HH | |
| | | mC/kg | Evaluation rank | LL/HH ratio | Evaluation rank | Q5min/Q2min ratio | Evaluation rank |
| Example 1 | Toner 1 | −46.0 | A | 1.19 | A | 1.19 | A |
| Example 2 | Toner 2 | −51.0 | A | 1.14 | A | 1.02 | A |
| Example 3 | Toner 3 | −41.0 | A | 1.20 | A | 1.18 | A |
| Example 4 | Toner 4 | −41.0 | A | 1.22 | A | 1.19 | A |
| Example 5 | Toner 5 | −39.0 | A | 1.24 | A | 1.17 | A |
| Example 6 | Toner 6 | −37.0 | A | 1.26 | A | 1.12 | A |
| Example 7 | Toner 7 | −44.0 | A | 1.19 | A | 1.16 | A |
| Example 8 | Toner 8 | −22.0 | B | 1.16 | A | 1.39 | B |
| Example 9 | Toner 9 | −29.0 | B | 1.20 | A | 1.16 | A |
| Example 10 | Toner 10 | −56.0 | A | 1.26 | A | 1.19 | A |
| Example 11 | Toner 11 | −26.5 | B | 1.41 | B | 1.36 | B |
| Example 12 | Toner 12 | −19.3 | C | 1.52 | C | 1.46 | C |
| Example 13 | Toner 13 | −18.0 | B | 1.18 | A | 1.33 | B |
| Example 14 | Toner 14 | −51.0 | A | 1.31 | B | 1.28 | B |
| Example 15 | Toner 15 | −45.0 | A | 1.25 | A | 1.24 | B |
| Example 16 | Toner 16 | −38.0 | A | 1.22 | A | 1.17 | A |
| Example 17 | Toner 17 | −28.0 | B | 1.19 | A | 1.15 | A |
| Example 18 | Toner 18 | −55.0 | A | 1.33 | B | 1.50 | C |
| Example 19 | Toner 19 | −15.0 | C | 1.13 | A | 1.22 | B |
| Example 20 | Toner 20 | −43.0 | A | 1.19 | A | 1.16 | A |
| Example 21 | Toner 21 | −37.9 | A | 1.24 | A | 1.19 | A |
| Example 22 | Toner 22 | −40.0 | A | 1.22 | A | 1.19 | A |

TABLE 3-continued

| | | | | | | | |
|---|---|---|---|---|---|---|---|
| Example 23 | Toner 23 | −22.0 | B | 1.10 | A | 1.27 | B |
| Example 24 | Toner 24 | −28.0 | B | 1.15 | A | 1.23 | B |
| Example 25 | Toner 25 | −31.0 | B | 1.19 | A | 1.17 | A |
| Example 26 | Toner 26 | −33.2 | B | 1.17 | A | 1.19 | A |

TABLE 4

| | | Toner summary | | | | | | |
|---|---|---|---|---|---|---|---|---|
| | | Feed (pbm) | Aromatic compound present in toner particles | Content a μmol/g | Charge-providing agent | Content μmol/g | Chief polar resin present in toner particles | Resin acid value mgKOH/g |
| Example 27 | Toner 27 | A 3.1 | 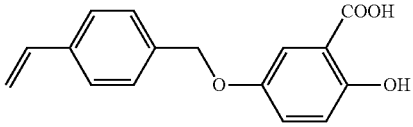 | 100.9 | LR147 | 28.0 | — | — |
| Example 28 | Toner 28 | C 3.7 | 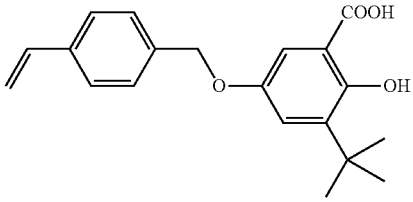 | 99.2 | LR147 | 27.8 | — | — |
| Example 29 | Toner 29 | E 3.4 | 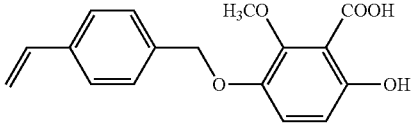 | 99.3 | LR147 | 27.9 | — | — |
| Example 30 | Toner 30 | H 3.1 | 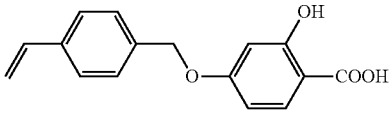 | 100.9 | LR147 | 28.0 | — | — |
| Example 31 | Toner 31 | I 3.1 | 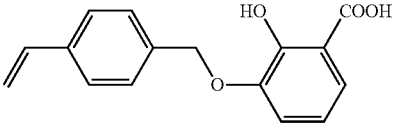 | 100.9 | LR147 | 28.0 | — | — |
| Example 32 | Toner 32 | D 4.3 | 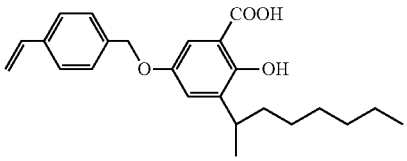 | 97.7 | LR147 | 27.7 | — | — |
| Example 33 | Toner 33 | L 3.1 | 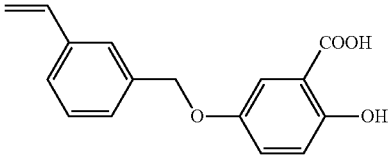 | 100.9 | LR147 | 28.0 | — | — |

TABLE 4-continued
| | | | | | | | | |
|---|---|---|---|---|---|---|---|---|
| Example 34 | Toner 34 | A 3.1 | 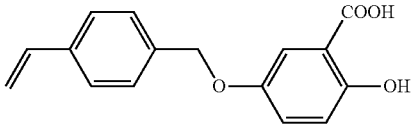 | 101.0 | T-77 | 19.7 | PES1 | 12.1 |
| Example 35 | Toner 35 | A 3.1 | 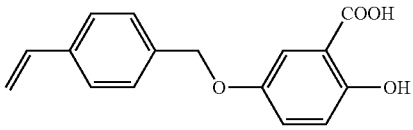 | 100.9 | P-51 | 28.1 | — | — |
| Example 36 | Toner 36 | A 0.0060 | 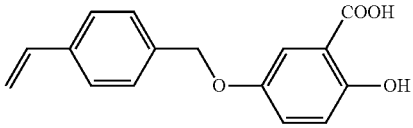 | 0.20 | LR147 | 28.7 | — | — |
| Example 37 | Toner 37 | A 0.10 | 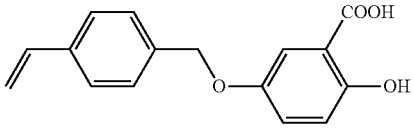 | 3.3 | LR147 | 28.7 | — | — |
| Example 38 | Toner 38 | A 0.45 | 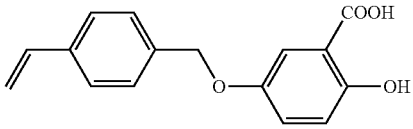 | 15.0 | LR147 | 28.7 | — | — |
| Example 39 | Toner 39 | A 0.90 | 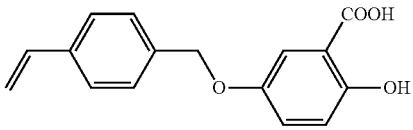 | 29.9 | LR147 | 28.5 | — | — |
| Example 40 | Toner 40 | A 6.0 | 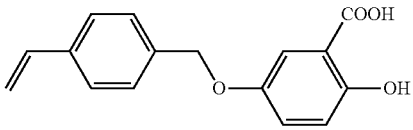 | 190.3 | LR147 | 27.3 | — | — |
| Example 41 | Toner 41 | A 7.0 | 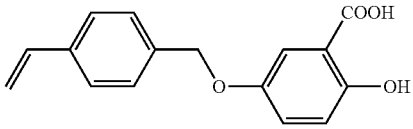 | 220.2 | LR147 | 27.1 | — | — |
| Example 42 | Toner 42 | A 3.3 | 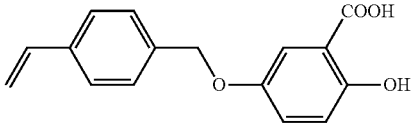 | 107.1 | LR147 | 28.0 | — | — |
| Example 43 | Toner 43 | A 3.1 | 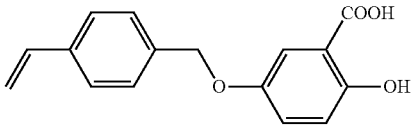 | 100.9 | LR147 | 28.0 | — | — |
| Example 44 | Toner 44 | A 7.1 | 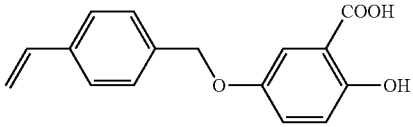 | 100.9 | LR147 | 28.0 | — | — |
| Comp. Example 1 | Toner 45 | — | — | — | — | — | PES1 | 12.12 |

TABLE 4-continued

| | | | | | | | | |
|---|---|---|---|---|---|---|---|---|
| Comp. Example 2 | Toner 46 | A 3.0 | 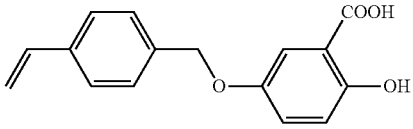 | 99.1 | — | — | — | — |
| Comp. Example 3 | Toner 47 | — | — | — | LR147 | 28.8 | — | — |
| Comp. Example 4 | Toner 48 | — | — | — | T-77 | 20.3 | — | — |

| | | Toner summary | | | | Evaluation results | | | | | |
|---|---|---|---|---|---|---|---|---|---|---|---|
| | | | | | | Saturated charge quantity in HH | | Environmental difference of saturated charge quantity | | Toner charging rise in HH | |
| | | Toner production process | Colorant | Toner particle surface acid value mgKOH/g | Toner particle diam. μm | mC/kg | Evaluation rank | LL/HH ratio | Evaluation rank | Q5min/Q2min ratio | Evaluation rank |
| Example 27 | Toner 27 | Kneading pulverization | C.I. Pig. Blue 15:3 | 0.068 | 7.1 | −47.1 | A | 1.19 | A | 1.12 | A |
| Example 28 | Toner 28 | Kneading pulverization | C.I. Pig. Blue 15:3 | 0.079 | 7.2 | −42.0 | A | 1.15 | A | 1.05 | A |
| Example 29 | Toner 29 | Kneading pulverization | C.I. Pig. Blue 15:3 | 0.045 | 7.1 | −44.0 | A | 1.21 | A | 1.16 | A |
| Example 30 | Toner 30 | Kneading pulverization | C.I. Pig. Blue 15:3 | 0.056 | 6.9 | −41.0 | A | 1.23 | A | 1.17 | A |
| Example 31 | Toner 31 | Kneading pulverization | C.I. Pig. Blue 15:3 | 0.055 | 6.9 | −40.0 | A | 1.23 | A | 1.19 | A |
| Example 32 | Toner 32 | Kneading pulverization | C.I. Pig. Blue 15:3 | 0.067 | 7.2 | −38.0 | A | 1.27 | A | 1.14 | A |
| Example 33 | Toner 33 | Kneading pulverization | C.I. Pig. Blue 15:3 | 0.060 | 7.0 | −41.0 | A | 1.18 | A | 1.15 | A |
| Example 34 | Toner 34 | Kneading pulverization | CB | 0.141 | 6.9 | −32.1 | A | 1.17 | A | 1.14 | A |
| Example 35 | Toner 35 | Kneading pulverization | C.I. Pig. Blue 15:3 | 0.076 | 6.8 | +20.0 | B | 1.20 | A | 1.19 | A |
| Example 36 | Toner 36 | Kneading pulverization | C.I. Pig. Blue 15:3 | 0.012 | 7.1 | −55.0 | A | 1.46 | B | 1.48 | C |
| Example 37 | Toner 37 | Kneading pulverization | C.I. Pig. Blue 15:3 | 0.035 | 7.3 | −50.0 | A | 1.33 | B | 1.31 | B |
| Example 38 | Toner 38 | Kneading pulverization | C.I. Pig. Blue 15:3 | 0.050 | 7.3 | −47.4 | A | 1.25 | A | 1.23 | B |
| Example 39 | Toner 39 | Kneading pulverization | C.I. Pig. Blue 15:3 | 0.064 | 7.1 | −45.5 | A | 1.21 | A | 1.17 | A |
| Example 40 | Toner 40 | Kneading pulverization | C.I. Pig. Blue 15:3 | 0.218 | 7.0 | −25.5 | B | 1.15 | A | 1.10 | A |
| Example 41 | Toner 41 | Kneading pulverization | C.I. Pig. Blue 15:3 | 0.313 | 6.8 | −18.1 | C | 1.29 | A | 1.13 | A |
| Example 42 | Toner 42 | Dissolution suspension | C.I. Pig. Blue 15:3 | 0.203 | 7.3 | −28.4 | B | 1.28 | A | 1.26 | B |
| Example 43 | Toner 43 | Kneading pulverization | CB | 0.221 | 7.0 | −47.0 | A | 1.17 | A | 1.10 | A |
| Example 44 | Toner 44 | Kneading pulverization | C.I. Pig. Violet 19 | 0.236 | 6.7 | −43.0 | A | 1.21 | A | 1.13 | A |
| Comp. Example 1 | Toner 45 | Kneading pulverization | C.I. Pig. Blue 15:3 | 0.110 | 7.1 | −34.4 | A | 2.20 | D | 2.30 | D |
| Comp. Example 2 | Toner 46 | Kneading pulverization | C.I. Pig. Blue 15:3 | 0.008 | 7.0 | −8.7 | D | 1.25 | A | 1.65 | D |
| Comp. Example 3 | Toner 47 | Kneading pulverization | C.I. Pig. Blue 15:3 | 0.002 | 6.8 | −9.8 | D | 2.41 | D | 1.58 | C |
| Comp. Example 4 | Toner 48 | Kneading pulverization | CB | 0.005 | 6.8 | −9.1 | D | 1.98 | C | 1.45 | C |

WHAT REFERENCE NUMERALS DENOTE

1, suction device; 2, measuring container; 3, screen; 4, lid; 5, vacuum indicator; 6, air-flow control valve; 7, suction opening; 8, capacitor; 9, electrometer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-111720, filed May 18, 2011, which is hereby incorporated by reference herein in its entirety.

What is claimed is:

1. A toner comprising toner particles each of which contains a charging component, an aromatic compound having a carboxyl group, and a colorant; wherein the aromatic compound is an aromatic compound represented by the following formula (1):

Formula (1)

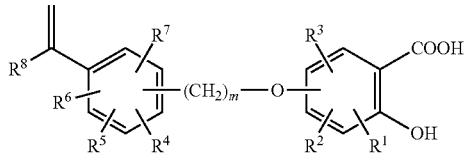

wherein $R^1$ to $R^3$ each independently represent a hydrogen atom, a hydroxyl group, a carboxyl group, an alkyl group having 1 to 18 carbon atom(s) or an alkoxyl group having 1 to 18 carbon atom(s); $R^4$ to $R^7$ each independently represent a hydrogen atom, a hydroxyl group, an alkyl group having 1 to 18 carbon atom(s) or an alkoxyl group having 1 to 18 carbon atom(s); $R^8$ represents a hydrogen atom or a methyl group; and m represents an integer of 1 to 3.

2. The toner according to claim 1, wherein the charging component is a binder resin having a polarity.

3. The toner according to claim 2, wherein the binder resin having a polarity has an acid value of from 2.0 mgKOH/g or more to 60.0 mgKOH/g or less.

4. The toner according to claim 1, wherein the charging component is an organometallic complex or chelate compound having positively charging performance or negatively charging performance, and toner further comprises a binder resin.

5. The toner according to claim 1, wherein the aromatic compound is contained in a content of from 0.10 μmol or more to 200 μmol or less per 1 g of the toner.

* * * * *